US011073123B2

(12) United States Patent
Andersson et al.

(10) Patent No.: US 11,073,123 B2
(45) Date of Patent: Jul. 27, 2021

(54) CONTROLLING A LIGHT-DUTY COMBUSTION ENGINE

(71) Applicant: Walbro LLC, Tucson, AZ (US)

(72) Inventors: Martin N. Andersson, Caro, MI (US); Matthew A. Braun, Caro, MI (US); Cyrus M. Healy, Ubly, MI (US); Shunya Nakamura, Iwanuma (JP); Tsuyoshi Watanabe, Shibata-county (JP)

(73) Assignee: Walbro LLC, Tucson, AZ (US)

( * ) Notice: Subject to any disclaimer, the term of this patent is extended or adjusted under 35 U.S.C. 154(b) by 105 days.

(21) Appl. No.: 16/316,756

(22) PCT Filed: Jul. 12, 2017

(86) PCT No.: PCT/US2017/041706
§ 371 (c)(1),
(2) Date: Jan. 10, 2019

(87) PCT Pub. No.: WO2018/013683
PCT Pub. Date: Jan. 18, 2018

(65) Prior Publication Data

US 2019/0293046 A1 Sep. 26, 2019

Related U.S. Application Data

(60) Provisional application No. 62/361,535, filed on Jul. 13, 2016, provisional application No. 62/427,089,
(Continued)

(51) Int. Cl.
*F02P 9/00* (2006.01)
*F02D 31/00* (2006.01)
(Continued)

(52) U.S. Cl.
CPC ..... *F02P 9/005* (2013.01); *F02D 9/02* (2013.01); *F02D 31/001* (2013.01); *F02P 1/083* (2013.01);
(Continued)

(58) Field of Classification Search
CPC .... F02P 9/002; F02P 9/005; F02P 5/15; F02P 5/1502; F02P 5/1508; F02P 5/06;
(Continued)

(56) References Cited

U.S. PATENT DOCUMENTS 6,439,547 B1 8/2002 King et al.
7,198,028 B2 4/2007 Andersson et al.
(Continued)

FOREIGN PATENT DOCUMENTS

CN 103573446 A 2/2014
CN 105317566 A 2/2016
(Continued)

OTHER PUBLICATIONS

Written Opinion & International Search Report for PCT/US2017/041706 dated Sep. 26, 2017, 14 pages.
(Continued)

*Primary Examiner* — Phutthiwat Wongwian
*Assistant Examiner* — Sherman D Manley
(74) *Attorney, Agent, or Firm* — Reising Ethington P.C.

(57) ABSTRACT

In at least some implementations, a method of maintaining an engine speed below a first threshold, includes: (a) determining an engine speed; (b) comparing the engine speed to a second threshold that is less than the first threshold; (c) allowing an engine ignition event to occur during a subsequent engine cycle if the engine speed is less than the second threshold; and (d) skipping at least one subsequent engine ignition event if the engine speed is greater than the second threshold. In at least some implementations, the second
(Continued)

threshold is less than the first threshold by a maximum acceleration of the engine after one ignition event so that an ignition event when the engine speed is less than the second threshold does not cause the engine speed to increase above the first threshold.

19 Claims, 22 Drawing Sheets

Related U.S. Application Data filed on Nov. 28, 2016, provisional application No. 62/488,413, filed on Apr. 21, 2017.

(51) Int. Cl.
*F02P 1/08* (2006.01)
*F02P 5/15* (2006.01)
*F02D 9/02* (2006.01)

(52) U.S. Cl.
CPC ..... *F02P 5/15* (2013.01); *F02P 5/1502* (2013.01); *F02P 9/002* (2013.01); *F02P 5/1508* (2013.01)

(58) Field of Classification Search
CPC ..... F02P 1/083; F02D 9/02; F02D 31/001; F02D 2009/023
See application file for complete search history.

(56) References Cited

U.S. PATENT DOCUMENTS

| | | | | |
|---|---|---|---|---|
| 7,427,057 | B1 | 9/2008 | Kampman et al. | |
| 7,699,039 | B2 | 4/2010 | Carlsson et al. | |
| 7,735,471 | B2 * | 6/2010 | Andersson | F02P 5/1504 123/406.54 |
| 9,080,545 | B2 | 7/2015 | Fong et al. | |
| 9,322,329 | B2 | 4/2016 | Gegg et al. | |
| 9,441,550 | B2 | 9/2016 | Li et al. | |
| 2002/0121710 | A1 | 9/2002 | King et al. | |
| 2005/0092290 | A1 * | 5/2005 | Gudgeon | F02P 9/005 123/335 |
| 2008/0223339 | A1 | 9/2008 | Carlsson et al. | |
| 2011/0155100 | A1 * | 6/2011 | Matsuda | B60T 8/1706 123/406.19 |
| 2012/0000442 | A1 | 1/2012 | Takigawa et al. | |
| 2012/0017871 | A1 * | 1/2012 | Matsuda | F02D 29/02 123/349 |
| 2013/0332049 | A1 * | 12/2013 | Larsson | F02D 41/04 701/103 |
| 2014/0165964 | A1 * | 6/2014 | Leufen | F02P 5/045 123/406.19 |
| 2016/0237977 | A1 * | 8/2016 | Assargard | F02B 25/00 |
| 2017/0306863 | A1 * | 10/2017 | Andersson | F02D 41/26 |
| 2019/0293006 | A1 * | 9/2019 | Abei | F02D 41/1475 |

FOREIGN PATENT DOCUMENTS

| | | | |
|---|---|---|---|
| EP | 1643121 | A2 | 4/2006 |
| WO | WO2016048199 | A1 | 3/2016 |
| WO | WO2016073811 | A1 | 5/2016 |

OTHER PUBLICATIONS

Swedish Office Action for Swedish Patent Application No. 1950023-0 dated Oct. 17, 2019 (8 pages).
Chinese Office Action for Chinese Application No. 201780043689.8 dated Mar. 1, 2021 (9 pages).

* cited by examiner

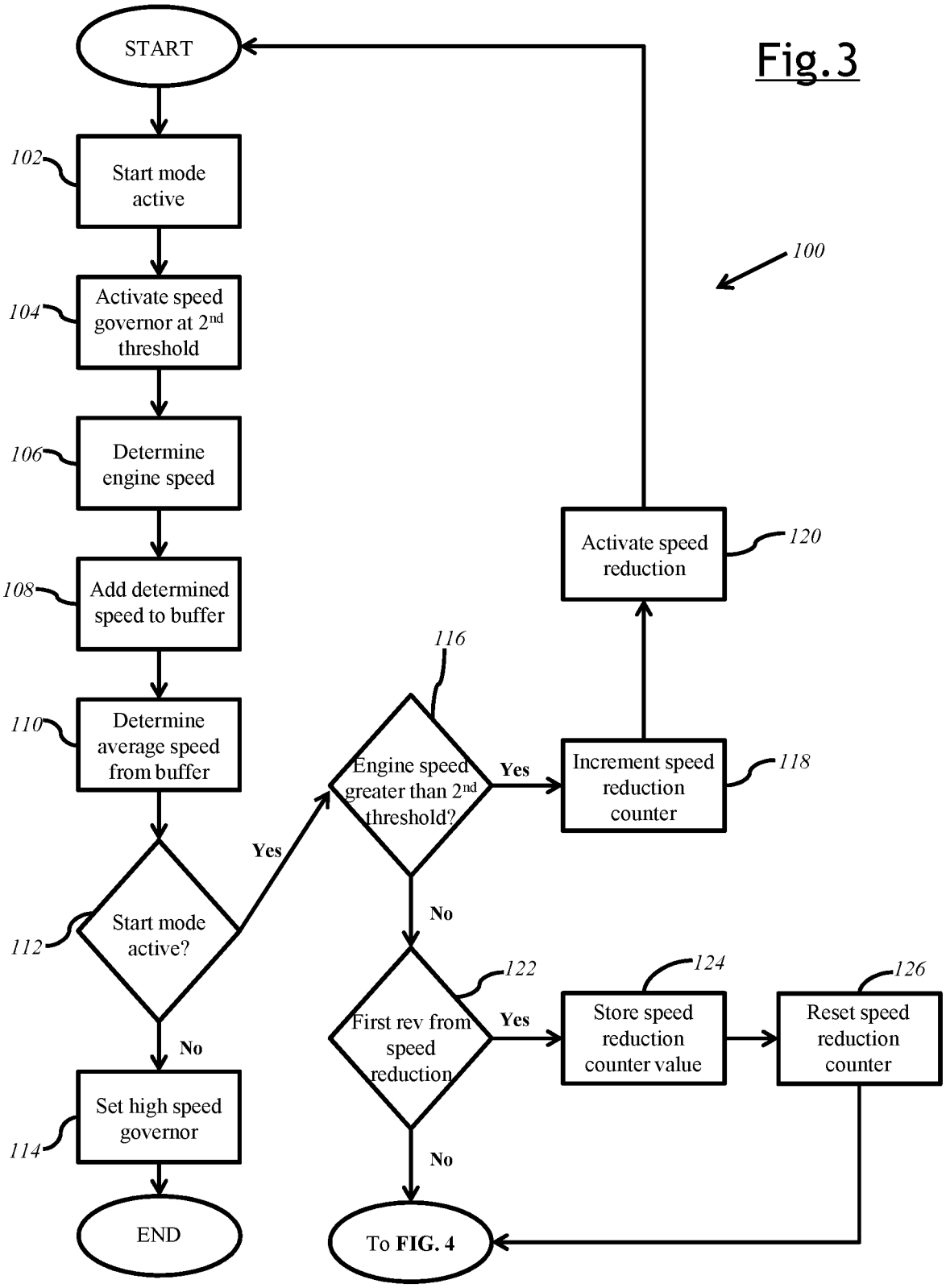
Fig. 3
100
START
102
Start mode active
104
Activate speed governor at 2nd threshold
106
Determine engine speed
108
Add determined speed to buffer
110
Determine average speed from buffer
112
Start mode active?
Yes
No
114
Set high speed governor
END
116
Engine speed greater than 2nd threshold?
Yes
No
118
Increment speed reduction counter
120
Activate speed reduction
122
First rev from speed reduction
Yes
No
124
Store speed reduction counter value
126
Reset speed reduction counter
To FIG. 4

CONTROLLING A LIGHT-DUTY COMBUSTION ENGINE

REFERENCE TO RELATED APPLICATIONS

This application claims the benefit of U.S. Provisional Application Ser. No. 62/361,535 filed on Jul. 13, 2016; 62/427,089 filed on Nov. 28, 2016; and 62/488,413 filed on Apr. 21, 2017, the entire contents of which are incorporated herein by reference.

TECHNICAL FIELD

The present disclosure relates generally to controlling a light-duty combustion engine, and more specifically to controlling an engine having an electronic engine speed governor that limits the speed of the engine.

BACKGROUND

Ignition timing can be an important aspect in the performance of an internal combustion engine. Generally, ignition timing relates to how early or late the spark plug fires in relation to the axial position of the piston within the cylinder.

For instance, when the engine is being operated at high speeds, it is desirable to initiate the combustion process early so that the combustion reaction has adequate time to develop and assert its force upon the piston. Thus, an ignition timing control system may deliver a spark to the combustion chamber before the piston reaches a top-dead-center (TDC) position. Conversely, if the engine is being operated at relatively low speeds, the control system may cause an ignition event at a point closer to TDC (either slightly before or slightly after).

SUMMARY

In at least some implementations, a method of maintaining an engine speed below a first threshold, includes:

(a) determining an engine speed;

(b) comparing the engine speed to a second threshold that is less than the first threshold;

(c) allowing an engine ignition event to occur during a subsequent engine cycle if the engine speed is less than the second threshold; and (d) skipping at least one subsequent engine ignition event if the engine speed is greater than the second threshold. In at least some implementations, the second threshold is less than the first threshold by a maximum acceleration of the engine after one ignition event so that an ignition event when the engine speed is less than the second threshold does not cause the engine speed to increase above the first threshold. In at least some implementations, the second threshold is at least 1,000 rpm lower than the first threshold. The method, in step (d), may include skipping consecutive ignition events to allow the engine speed to decrease during consecutive engine cycles.

In addition to any or all of the above or separately, the method may include determining when the user actuates a throttle valve associated with the engine and wherein the method terminates when throttle valve actuation is detected or a fast-idle mode is terminated. A switch having at least two states may be associated with the throttle valve and wherein the step of determining when the user actuates the throttle valve is may be accomplished by determining a change in the state of the switch. In addition to any or all of the above or separately, the step of determining when the user actuates the throttle valve may be accomplished by providing additional ignition events during a test period and comparing at least one of the engine speed, engine speed change or rate of engine speed change in one or more subsequent revolutions to one or more thresholds to determine if the throttle valve has been actuated.

In at least some implementations, a method for controlling a light-duty combustion engine having a clutch with a clutch-in speed, includes the steps of:

(a) activating an engine speed governor that limits the speed of the engine to a first threshold that is less than the clutch-in speed of the clutch;

(b) determining if the engine is being operated in a normal idle mode, a wide open throttle mode, or is decelerating from a fast idle mode to a normal idle mode; and (c) if the engine is in a normal idle mode, a wide open throttle mode, or is decelerating from a fast idle mode to a normal idle mode, then deactivating the engine speed governor so that the engine can subsequently operate at a level that is greater than the clutch-in speed of the centrifugal clutch.

Step (a) above, may further include activating an engine speed governor that limits the speed of the light-duty combustion engine by skipping at least one ignition event. IN the method, determining if the engine is in normal idle mode may be done by comparing the engine speed to at least one engine speed threshold that is lower than the first threshold for multiple engine revolutions. In addition to any or all of the above or separately, the step of determining if the engine is decelerating from a fast idle mode to a normal idle mode may be done by detecting deceleration of the engine for a threshold number of consecutive engine revolutions. In addition to any or all of the above or separately, the method may include counting the number of consecutive engine revolutions without an ignition event and storing that number in a buffer, and the step of determining if the engine is in wide open throttle mode may be done by analyzing the values stored in the buffer.

In at least some implementations, a control system for use with a light-duty combustion engine, includes:

an ignition discharge capacitor that is coupled to a charge winding for receiving and storing a charge;

an ignition switching device that is coupled to the ignition discharge capacitor and includes a signal input; and an electronic processing device that executes electronic instructions and includes a signal output coupled to the signal input of the ignition switching device, the signal output provides an ignition signal that causes the ignition switching device to discharge the ignition discharge capacitor according to an engine ignition timing. Following engine startup the control system activates an engine speed governor to limit the speed of the engine, and deactivates the engine speed governor if the control system senses that the engine is in a normal idle mode, a wide open throttle mode, or is decelerating from a fast idle mode to a normal idle mode. In at least some implementations, the engine speed governor limits the speed of the light-duty combustion engine by skipping at least one ignition event when the engine meets or exceeds the first threshold.

In at least some implementations, in combination with or separately from the above noted methods, a method for maintaining an engine speed below a first threshold, includes the steps of:

(a) setting a counter to a first value;

(b) determining if a current engine speed is less than a second threshold that is less than the first threshold, and if not, setting the counter to a second value different than the first value, and if so, then proceeding to step (c);

(c) checking the counter value to see if the counter value is equal to the first value, and if so, then proceeding to step (d) and if not, then proceeding to step (e);

(d) allowing an ignition event to occur in the engine and then proceeding to step (f);

(e) preventing an ignition event from occurring in the engine, then changing the counter value to a value closer to the first value and then proceeding to step (f);

(f) after step (d) or step (e) determining if the current engine speed is less than a third threshold, and if so, returning to step (b) and if not, then setting the counter to a third value.

In at least some implementations, the magnitude of the second value is a function of the magnitude by which the engine speed is greater than the second threshold, and/or the second value is the same as the third value. In addition to any or all of the above or separately, the third threshold may be less than the second threshold and the third value may be less than the second value. In addition to any or all of the above or separately, the third value may represent a normal engine idling speed or a range of engine idling engine speeds, and/or the second threshold may represent a fast idle engine speed or a range of engine speeds associated with a fast idling engine. In addition to any or all of the above or separately, the method may include the step of advancing the engine ignition timing before step (b) to increase the engine speed compared to an ignition timing that is less advanced, and/or the step of changing the ignition timing to a less advanced timing if the engine speed is greater than the second threshold.

In at least some implementations, a charge forming device, includes:

a body having a main bore through which fuel and air flows for delivery to an engine;

a throttle valve associated with the main bore to at least in part control air flow through the main bore and having a first position in which a minimum flow area is provided between the valve and main bore, a second position in which a maximum flow area is provided between the valve and main bore and an intermediate position between the first position and the second position; and a detection element associated with the throttle valve to provide an indication of throttle valve movement from the intermediate position to another position. The detection element may be one of a sensor or a switch. A lever may be provided that releasably holds the throttle valve in the intermediate position and the detection element may be responsive to movement of the lever after the throttle valve is in the intermediate position. In at least some implementations, the detection element is a switch having two states and the state of the switch is changed by movement of the lever.

BRIEF DESCRIPTION OF THE DRAWINGS

These and other objects, features and advantages will be apparent from the following detailed description of the preferred embodiments, appended claims and accompanying drawings in which:

FIGS. 3 and 4 are flowcharts showing an embodiment of a method for controlling a light-duty engine that uses an engine speed governor to limit the speed of the engine;

DETAILED DESCRIPTION

Figure 1:
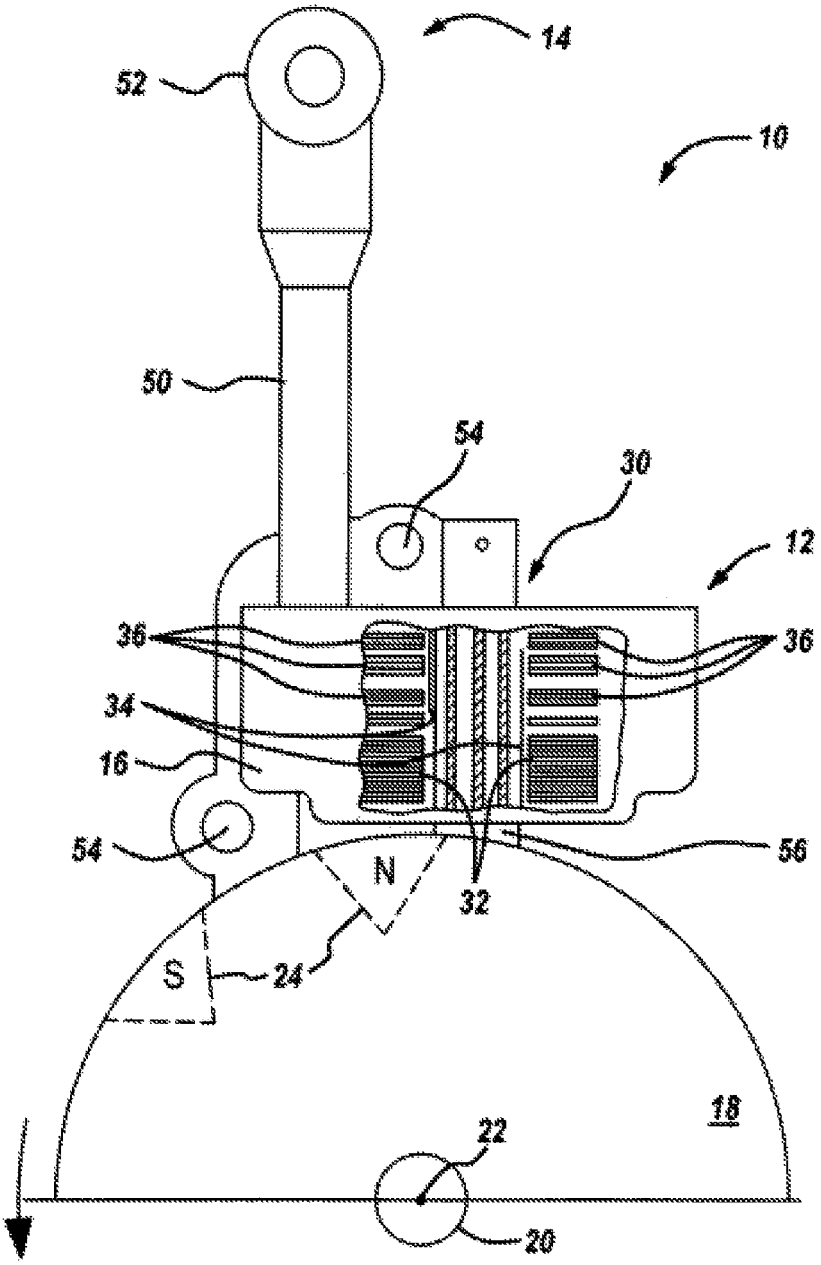
FIG. 1 is an elevation view of an embodiment of a signal generation system, including a cutaway section showing parts of a control system.
Figure 2:
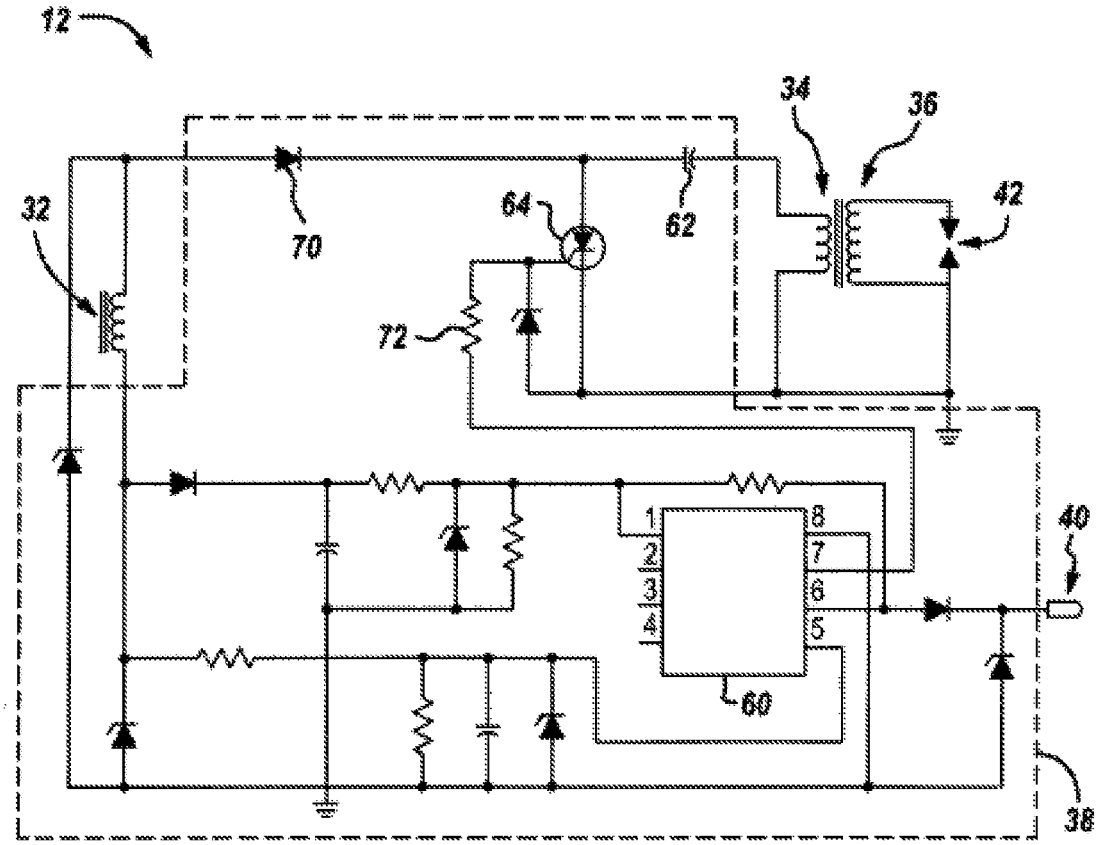
FIG. 2 is a schematic view of an embodiment of the control system of FIG. 1.

Referring to FIGS. 1 and 2, there is shown an embodiment of a signal generation system 10 that can be used with a light-duty combustion engine having a centrifugal clutch, such as the type typically employed by lawn and garden equipment. The term 'light-duty combustion engine' broadly includes all types of non-automotive combustion engines—this includes engines that are two-strokes, four-strokes, carbureted, fuel-injected, and direct-injected, to name but a few. Light-duty combustion engines may be used with hand-held power tools, lawn and garden equipment, lawnmowers, grass trimmers, edgers, chain saws, snowblowers, personal watercraft, boats, snowmobiles, motorcycles, all-terrain-vehicles, etc.

According to the implementation shown here, signal generation system 10 includes a control system 12, an ignition lead 14 and a housing 16, and it interacts with a flywheel 18. The flywheel is a weighted disk-like component that is coupled to a crankshaft 20 and rotates about an axis 22 under the power of the engine. By using its rotational inertia, flywheel 18 moderates fluctuations in engine speed, thereby providing a more constant and even output. Furthermore, flywheel 18 includes magnets or magnetic sections 24 that, when the flywheel is rotating, spin past and electromagnetically interact with components of control system 12 such that a signal indicative of the rotational speed of the flywheel, and hence the engine, may be determined or obtained. This signal may be used for a number of purposes and can provide information pertaining to the number of engine revolutions, the engine position, and/or the engine speed.

Control system 12 is responsible for managing the ignition of the engine and, according to the embodiment shown here, comprises a lamstack 30, a charge winding 32, a primary ignition winding 34, a secondary ignition winding 36, a control circuit 38, and a kill-switch 40. As magnets 24 rotate past lamstack 30, which can include a stack of ferromagnetic or magnetically permeable laminate pieces, a magnetic field is introduced in the lamstack which causes a voltage in charge winding 32. Preferably, charge winding 32 surrounds lamstack 30 such that the lamstack is generally positioned along the center axis of the charge winding. Primary ignition winding 34 can also surround lamstack 30 and inductively interact with a secondary ignition winding 36. As is commonly known in capacitive discharge ignition (CDI) systems, a spark is created in a spark plug 42 by discharging a capacitor across primary winding 34, such that it induces a high voltage pulse in secondary winding 36. Kill-switch 40 provides the user with a quick, easy to use means for shutting off the engine and, according to one embodiment, is a 'positive stop/automatic on' type switch. A more detailed account of control system 12 is subsequently provided in conjunction with FIG. 2.

Ignition lead 14 couples control system 12 to spark plug 42 so that the control system can send high voltage ignition pulses to the spark plug, and generally includes an elongated copper wire connector 50 and a boot 52. Connector 50 conducts the high voltage ignition pulse along an electrical conductor surrounded by a protective insulated sheathing. The boot 52 is designed to receive the terminal end of the spark plug, such that the two components are both physically secured to each other and electrically connected. Of course, numerous types of boots are known to those skilled in the art and could be used to accommodate a variety of spark plug terminal ends.

Housing 16 protects the components of control system 12 from what is oftentimes a harsh operating environment. The housing, which can be made from metal, plastic or any other suitable material, surrounds lamstack 30 and allows for a small air gap 56 to exist between the lamstack and the outer periphery of flywheel 18. The air gap should be small enough to allow for sufficient electromagnetic coupling, yet large enough to account for tolerance variances during operation. The mounting features 54 shown here are holes designed to accommodate corresponding bolts, however, suitable alternative mounting features could be used in their place.

In engine operation, movement of a piston turns crankshaft 20, which in turn rotates flywheel 18. As the magnets 24 of the flywheel rotate past lamstack 30, a magnetic field is created which induces a voltage in the nearby charge winding 32; this induced voltage may be used for several purposes. First, the voltage can power control circuit 38. Second, the induced voltage can charge a capacitor that stores energy until it is instructed to discharge, at which time energy is discharged across primary ignition winding 34. Lastly, the voltage induced in charge winding 32 can be used to produce an engine speed signal which is supplied to control circuit 38. This engine speed signal may play a role in the control of the engine, as will be subsequently explained in greater detail.

Turning now to FIG. 2, there is shown an embodiment of control system 12 which includes a control circuit 38 for managing the ignition of a light-duty combustion engine. Of course, the particular control circuit embodiment shown here is but one example of the type of circuit that may be included within control system 12 and used with the present method, as other circuit embodiments could be used instead. Control circuit 38 interacts with the other elements of control system 12, and generally includes an electronic processing device 60, an ignition discharge capacitor 62, and an ignition switching device 64.

Electronic processing device 60 preferably includes one or more inputs and outputs, and is designed to execute electronic instructions that may be used to control various aspects of engine operation; this can include, for example, ignition timing, air/fuel control, etc. The term 'electronic processing device' broadly includes all types of microcontrollers, microprocessors, as well as any other type of electronic device capable of executing electronic instructions. In the particular arrangement shown here, pin 1 is coupled to charge winding 32 via a resistor and diode, such that an induced voltage in the charge winding supplies electronic processing device 60 with power. Also, when a voltage is induced in the charge winding 32, as previously described, current passes through a diode 70 and charges ignition discharge capacitor 62, assuming ignition switching device 64 is in a non-conductive state. The ignition discharge capacitor 62 may hold the charge until electronic processing device 60 changes the state of ignition switching device 64, at which time the energy stored in the capacitor is discharged. Pin 5 is also coupled to charge winding 32 and receives an electronic signal representative of the engine speed. Pin 6 may be coupled to kill switch 40, which acts as a manual override for shutting down the engine. Pin 7 is coupled to the gate of ignition switching device 64 via a resistor 72, and transmits an ignition signal which controls the state of the switching device. Lastly, pin 8 provides the electronic processing device with a ground reference.

In operation, charge winding 32 experiences an induced voltage that charges ignition discharge capacitor 62, and provides electronic processing device 60 with power and an engine speed signal. As capacitor 62 is being charged, the electronic processing device 60 may execute a series of electronic instructions that utilize the engine speed signal to determine if and how much of a spark advance or retard is needed. Electronic processing device 60 can then output an ignition signal on pin 7, according to the calculated ignition timing, which turns on switching device 64. Once turned on (meaning a conductive state), a current path through switching device 64 and primary winding 34 is formed for the charge stored in capacitor 62. The current through the primary winding induces a high voltage ignition pulse in secondary winding 36. This high voltage pulse is then delivered to spark plug 42 where it arcs across the spark gap, thus beginning the combustion process. If at any time kill switch 40 is activated, the electronic processing device stops and thereby prevents the control system from delivering a spark to the combustion chamber.

It should be appreciated that the method and system described below could be used with one of a number of light-duty combustion engine arrangements, and are not specifically limited to the systems, circuits, etc. previously described.

The following description is generally directed to a method for controlling a light-duty combustion engine and, more specifically, to a method that uses an engine speed governor to limit the engine speed so that it is less than a clutch-in speed of a centrifugal clutch. Persons of ordinary skill in this art will appreciate that the example method shown in FIG. 3 may be used at start-up or at some other time, and it is only one of a number of different methods that may be used to control the light-duty combustion engine. For example, the example method may be used in conjunction with any combination of additional operating sequences designed to optimally control the ignition timing under certain operating conditions. Some examples of suitable operating sequences that could be used with the method include those disclosed in U.S. Pat. No. 7,198,028, which is also assigned to the present assignee. Because various operating sequences are already known in the art, a duplicative description of them has been omitted here.

The flowchart shown in FIG. 3 sets forth at least some of the steps of a representative method 100 for controlling a light-duty combustion engine. Method 100 may be executed immediately following start-up of the engine, after an initial operating sequence such as a cranking sequence (see U.S. Pat. No. 7,198,028 for more details), or at any other time when it is desirable to maintain the engine speed below a certain level or first threshold, such as a clutch-in speed of a centrifugal clutch. Although method 100 is described below in the context of a fast idle start-up operating sequence—i.e., a stand-alone operating sequence specifically designed to warm up the engine by operating it at speeds between idle and wide open throttle (WOT)—it should be appreciated that the method could be part of a different stand-alone operating sequence or it could be integrated into a larger operating sequence, to cite a few possibilities.

In step 102, a start mode is activated. The start mode is a method of controlling engine operation during initial starting and warming up of the engine. The start mode may include or work in conjunction with an initial or low speed engine speed governor, and may facilitate a handoff between the low speed engine speed governor and user control of the engine speed via an user actuated throttle control.

In step 104 the low speed engine speed governor is activated to limit the engine speed to a second threshold that is less than the clutch-in speed of a centrifugal clutch. In one example, the clutch-in speed or first threshold is 4,000 rpm and the second threshold is 3,500 rpm. These values are merely representative of one possible situation and the values will change based on application, engine or otherwise, as desired.

In step 106, the engine speed is determined and in step 108 the determined engine speed is added to a buffer. In at least some implementations, the engine speed may be determined for each engine revolution. Other implementations may determine and store engine speed less often (e.g. every other revolution, or at some other interval which need not be evenly spaced). The buffer may be cleared after the start mode is deactivated, as noted below, or when the engine is turned off, so the first engine speed reading after the method is commenced will be the first engine speed stored in the buffer. Any desired number of subsequent engine speed readings may be added to the buffer. In one example, the buffer is a first-in and first-out buffer that stores 8 engine speeds, so when the ninth engine speed is stored the first engine speed is no longer stored in the buffer. While termed engine speeds, the data stored in the buffer might relate to a time for an engine revolution or some other data that is related to engine speed.

In step 110, a representative engine speed is determined as a function of one or more of the stored engine speeds in the buffer. The representative engine speed may be determined in any desired way, including but not limited to the mean, median or mode of all or some of the engine speeds in the buffer. In one implementation, the mean engine speed is used as a way to reduce the effects of unstable engine operation and associated spikes in engine speeds.

In step 112 a check is performed to determine if the start mode is still active or if it has been deactivated. If start mode is not active, then a high speed governor is implemented at step 114 to limit the engine speed below a third threshold. This may be done, for example, to prevent the engine from achieving a speed higher than desired, and which might damage the engine. The third threshold may be set as desired for a given engine or application, and in one example is about 14,000 rpm.

If it is determined in step 112 that start mode is still active, then it is determined in step 116 if the representative engine speed from step 110 is greater than the second threshold. If it is greater, than a speed counter is incremented at 118 to record the number of times this loop in the routine is implemented. Next, a speed reduction feature is activated or implemented at step 120 to reduce the engine speed. In at least some implementations, the next ignition event is prevented to prevent combustion of a fuel mixture in the engine. In other implementations, the ignition timing may be altered, a fuel and air mixture may be varied, or both may be done to slow the engine down. After the speed reduction feature is implemented, the method returns to step 106 and the engine speed is determined.

Figure 4:
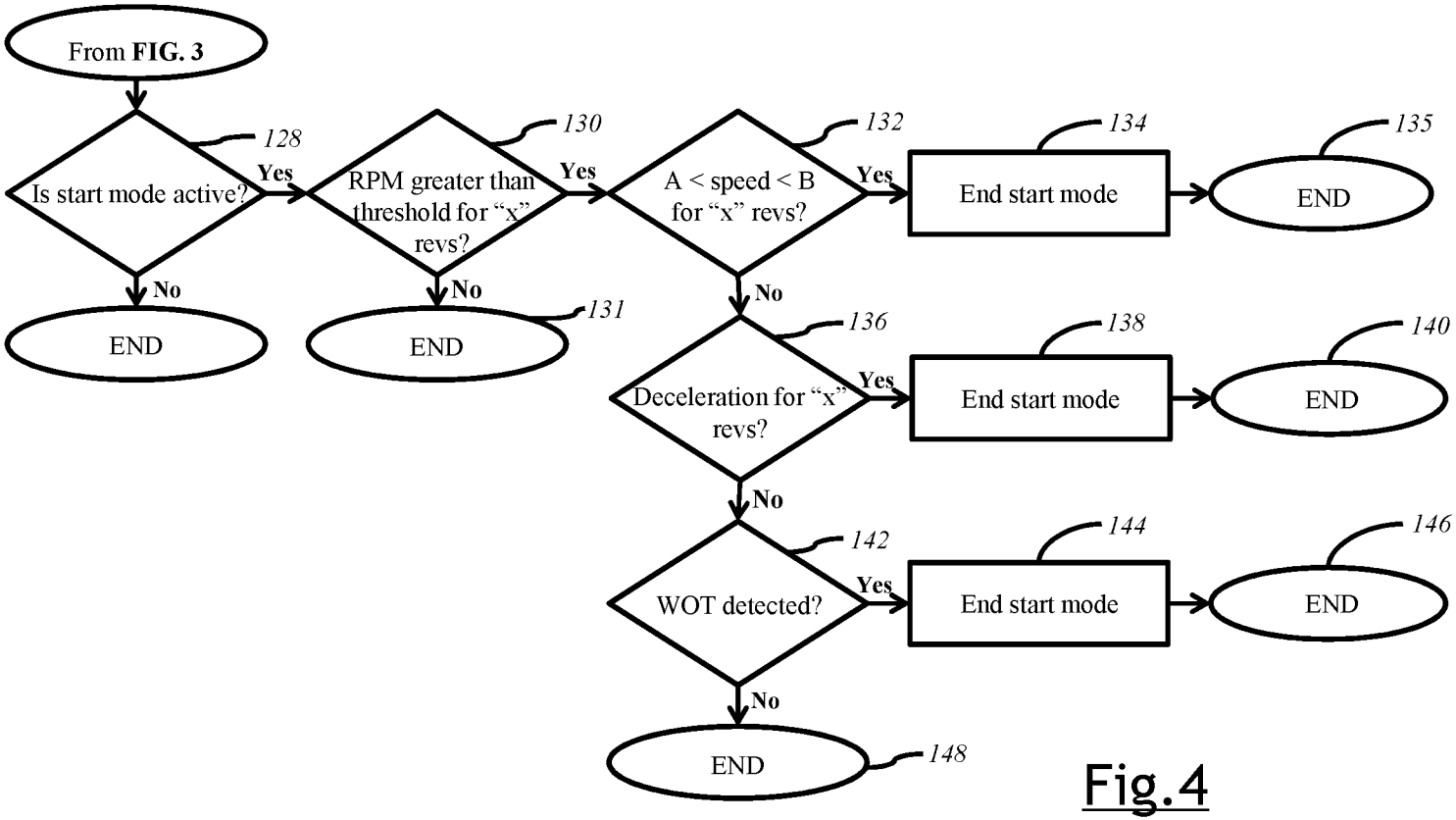

If it is determined in step 116 that the representative engine speed is not greater than the second threshold, then in at least implementations where the method is performed every engine revolution, a check is made at 122 to determine if this is the first engine revolution after a speed reduction feature has been implemented. If it is the first revolution after speed reduction, then the value in a speed reduction counter is stored in a buffer at 124, the speed reduction counter is reset at 126 and the method continues to step 128. The speed reduction counter buffer may include one or more values from previous loops in the method, as desired. In one implementation, the buffer holds 16 values although any other number of values may be stored, as desired. If it is determined at 122 that the method has proceeded to this point and is not a first revolution after a speed reduction event, then the method proceeds to step 128, shown in FIG. 4.

In step 128, a check may be performed to ensure that start mode is active to avoid performing further steps if that mode has been deactivated. If start mode is not active, the method ends at 129. If start mode is active, the method continues to 130 wherein it is determined if the engine speed has exceeded a fourth threshold speed for a certain number of revolutions, where the threshold speed and number of revolutions needed may vary as desired. This may help to ensure that the engine has been operating long enough to have reached a steady state, or a generally steady state, so that further review of engine speed and operating characteristics may be deemed more useful in detecting intended engine operation, as will be set forth in more detail below. In at least one implementation, the fourth threshold may be 2,500 rpm and the number of revolutions is 10. Accordingly, if the engine has not been at 2,500 rpm or greater for the last 10 revolutions (or, alternatively, if any 10 revolutions have been at 2,500 rpm or greater since the engine was started) then a normal engine ignition event may be provided by the control circuit to facilitate continued engine operation and the method ends at 131 and returns to the start at 102. If the desired number of revolutions were at the fourth threshold or greater, then the method continues to step 132.

In step 132, it is determined if the engine has stayed between a fifth threshold (shown as A in FIG. 4) and a sixth threshold (shown as B in FIG. 4) for a desired number of revolutions where the threshold speeds and number of revolutions needed may vary as desired. For example, the threshold speeds or the number of revolutions or both may be changed as a function of time since the engine was started, engine temperature, or both. A lookup table, map or other data set may be provided to set the desired threshold speeds and/or the number of revolutions needed to be within the thresholds. In one implementation, the fifth threshold is 2,200 rpm and the sixth threshold is 3,550 rpm, which is, but does not have to be, close to and slightly greater than the second threshold. Also in this implementation, the number of revolutions varies with the engine temperature and, in at least one example, a colder engine temperature provides a higher number of revolutions to satisfy this determination than does a warmer engine temperature. A colder engine may be less stable and see more variation in revolution to revolution speed, so a higher number of revolutions may be needed to determine that the engine is operating between the fifth and sixth thresholds. For example, the fast idle mode may have a speed limit greater than the second threshold, but a cold engine may struggle to achieve that speed for a few revolutions after the engine is started. Accordingly, it may take more revolutions to determine if a cold engine is in fast idle mode than it would take for a warmer engine.

If it is determined that the engine is operating between the fifth and sixth thresholds for the requisite number of revolutions, then it is determined that the engine is being operated at a normal idle speed (e.g. idle throttle position) and not a fast idle speed or greater speed. At normal idle speed the speed limiting function of the start mode is not needed because normal idle speed is below the clutch-in speed (first threshold) so no tool actuation will occur during normal idle speed engine operation. When the determination has been made that the engine is being operated in normal idle mode, the start mode can be terminated at 134, or set to inactive and the low speed governor at the second threshold is removed and the method ends at 135. Subsequent throttle actuation as commanded by the user will begin higher speed operation of the engine without interference by the speed limiting or governing associated with start mode. If in step 132 it is determined that the engine speed has not been between the fifth and sixth thresholds for the requisite number of revolutions, then the process continues at step 136.

In step 136, it is determined if the engine has decelerated for a threshold number of consecutive revolutions, which can be set as desired for a particular engine or application. In one implementation, the threshold is eight revolutions, although any desired number may be used and it may vary depending upon one or more factors (e.g. engine speed relative to normal idle speed, or other). Desirably, the number is set to a level that is greater than the consecutive number of revolutions of decreasing speed that are experienced with the engine in either fast idle, idle or wide open throttle with the speed governing applied. If the engine speed has decreased for each of the threshold number of consecutive revolutions, it is assumed that the engine was in fast idle mode and is returning to normal idle mode. As noted above, one way this occurs is by user actuation of a throttle control, usually a momentary actuation, to disengage the fast idle mode by and reduce the engine speed to idle mode. When fast idle mode is terminated by whatever means, the engine speed decreases to idle speed if the throttle is moved to the idle position. When termination of fast idle mode is determined as noted above, then the start mode may be terminated at step 138 and the method ends at 140 as the user is deemed to be in control of the engine and associated tool and ready for use of the tool. If the engine speed has not decreased for the requisite number of revolutions, then the method continues to step 142.

In step 142, a determination is made as to whether the throttle is in its wide open position. This determination is made based upon the engine speed data acquired in the method 100. In at least one implementation, the data in the speed reduction counter buffer is analyzed to determine throttle position (i.e. user intended engine operating mode). At higher engine speeds, there is likely to be more engine revolutions in which the ignition event is skipped, and the speed reduction counter is incremented, than at lower engine speeds. Hence, at wide open throttle engine operation there would be more ignition events skipped than at fast idle engine operation (each ignition event with the throttle in the wide open position will have more fuel to burn than when the throttle is in the fast idle position. Hence, when the throttle is wide open, an ignition event is likely to create more power and drive the engine to a higher speed and thus, more revolutions will be needed for the engine to come down to a level below the second threshold before a subsequent ignition event will be permitted. This provides a higher number in the speed reduction counter, which is then stored to the buffer). Hence, the magnitude that the engine speed exceeds the speed limiting/second threshold can provide information regarding the throttle position, with a greater magnitude of engine speed above the second threshold experienced when the throttle is wide open than when the throttle is in the fast idle position. An analysis of the buffer data can then lead to the determination of whether the throttle valve is in the wide open position (e.g. a user has actuated a throttle control to cause the throttle valve to be wide open).

In at least one implementation, the average or mean value in the buffer from the speed reduction counter is subtracted from the maximum value in the buffer, and the difference is compared to a threshold (that may vary or be set as desired). In one implementation, the threshold is 4, and if the difference is 4 or greater it is determined that the throttle is in the wide open position. For example, if the buffer includes 4 values of 9, 12, 6 and 5, the maximum value is 12 and the average value is 8 leaving a difference of 4 which leads to a determination that the throttle valve is wide open. Because the user has actuated the throttle valve to its wide open position, it is assumed that the user has control of the engine and tool and so the start mode and associated speed reduction can be terminated at step 144 and the method ends at 146. If the difference of the maximum buffer value minus the average buffer value is less than 4, then it is determined that the throttle is not in the wide open position and the method ends at 148 and returns to the start for the next engine revolution with start mode still active.

The difference between the maximum value and average value in the buffer is greater at wide open throttle than at fast idle. This is because, in this scenario, the engine is initially started at fast idle and there is a limited speed differential between fast idle and the second threshold so the number of ignition events skipped to reduce engine speed below the second threshold is lower, and continued fast idle engine operation would see less variability between the maximum value and the average value. However, when the engine is started at fast idle and the throttle is then moved to wide open, there will be more variability in the values in the buffer. In this situation, the maximum value in the buffer will be generated at wide open throttle as a greater number of ignition events will need to be skipped before the engine speed falls below the second threshold after an ignition event occurs. Further, the buffer will include values associated with fast idle operation (which tend to be lower values as noted above) that occurred before the throttle was moved to wide open. Therefore, the maximum value will exceed the average value by a greater amount when the throttle was initially at fast idle and then moved to wide open, then when the throttle remains in the fast idle position. Of course, the values in the buffer may be used in other ways to determine if the throttle has moved from fast idle to wide open throttle, as desired.

In the situations noted herein, it is not need to determine if the throttle was in the normal idle position and then moved to wide open throttle because, as noted above, upon determining that the throttle valve is in the normal idle position, the speed governing function is terminated so subsequent high speed, wide open throttle engine operation is permitted. Hence, only the change from fast idle to wide open throttle position needs to be determined. In other systems, a change from idle to wide open throttle could be identified, if desired. Further, some systems permit a user to start an engine with the throttle in the wide open position, and this may be detected by analysis of the speed data and/or the speed reduction counter data as noted.

Figure 5:
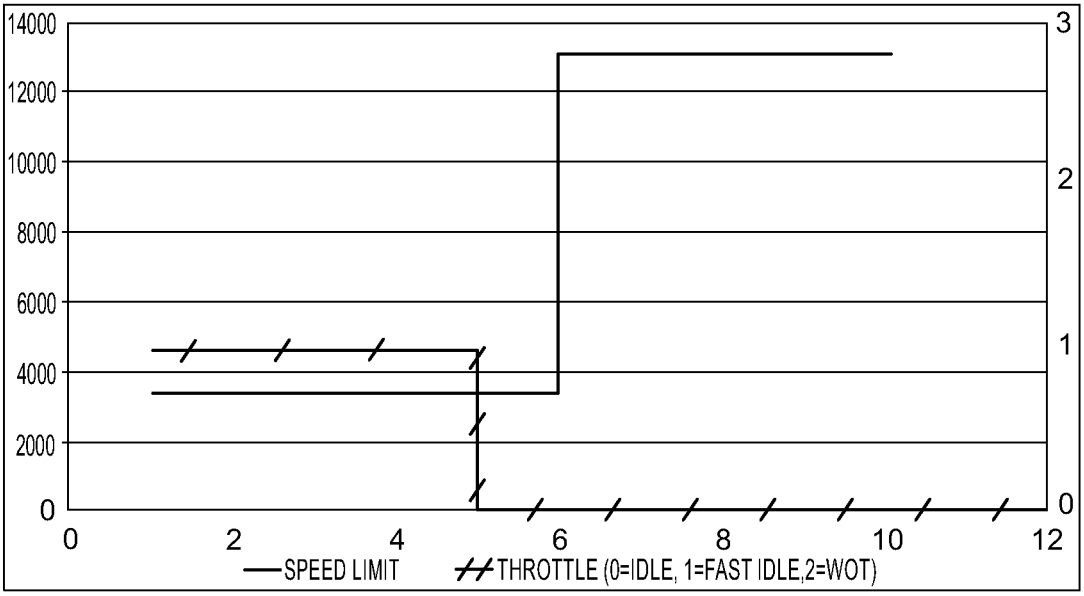
FIG. 5 is a graph of an engine speed limit and throttle position.

FIG. 5 shows a plot of throttle position against an engine speed limit setting. The throttle position plot is show at values of zero which corresponds to normal idle position; one which corresponds to fast idle position and two which corresponds to wide open position. The engine speed plot is shown as a nominal rpm threshold, with rpm on the y-axis and number of revolutions on the x-axis. At revolution number one, the throttle is in the fast idle position (value=one) and the speed limit is set to the second threshold which in this example is shown to be about 3,500 rpm. This remains until revolution five at which the throttle valve is moved to the normal idle position (value=zero). Once the throttle valve position change is recognized or determined, the second threshold speed limit is removed and the third threshold or high speed engine speed limit is activated to limit the maximum speed of the engine as noted above. Determination of the throttle valve change to normal idle is shown to take one revolution, but may take more revolutions than that for the average engine speed to decrease sufficiently for that determination to be made.

Figure 6:
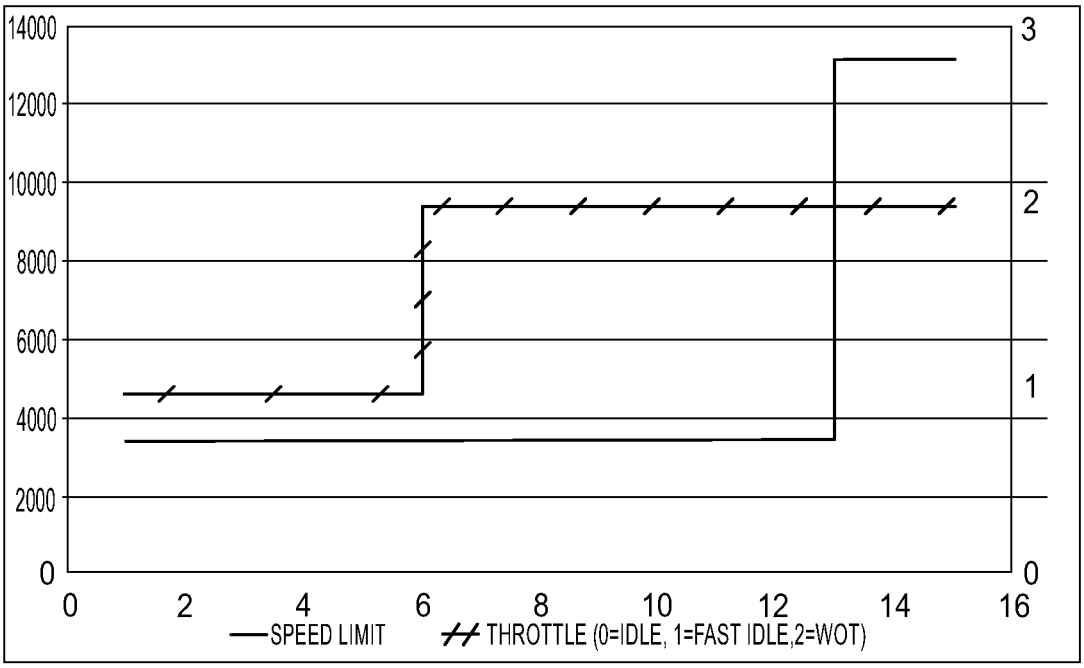
FIG. 6 is another graph of engine speed limit and throttle position.

FIG. 6 shows a plot similar to FIG. 5, but the throttle position is changed at revolution six from the fast idle position to the wide open position. Once this throttle position change is determined, the second threshold speed limit is removed and the third threshold speed limit is activated. This is shown to occur in revolution thirteen, which is seven revolutions after the throttle valve was moved. Of course, it may take more of fewer revolutions for the determination to be made within the method as noted above (e.g. depending on the values in the buffer).

Figure 7:
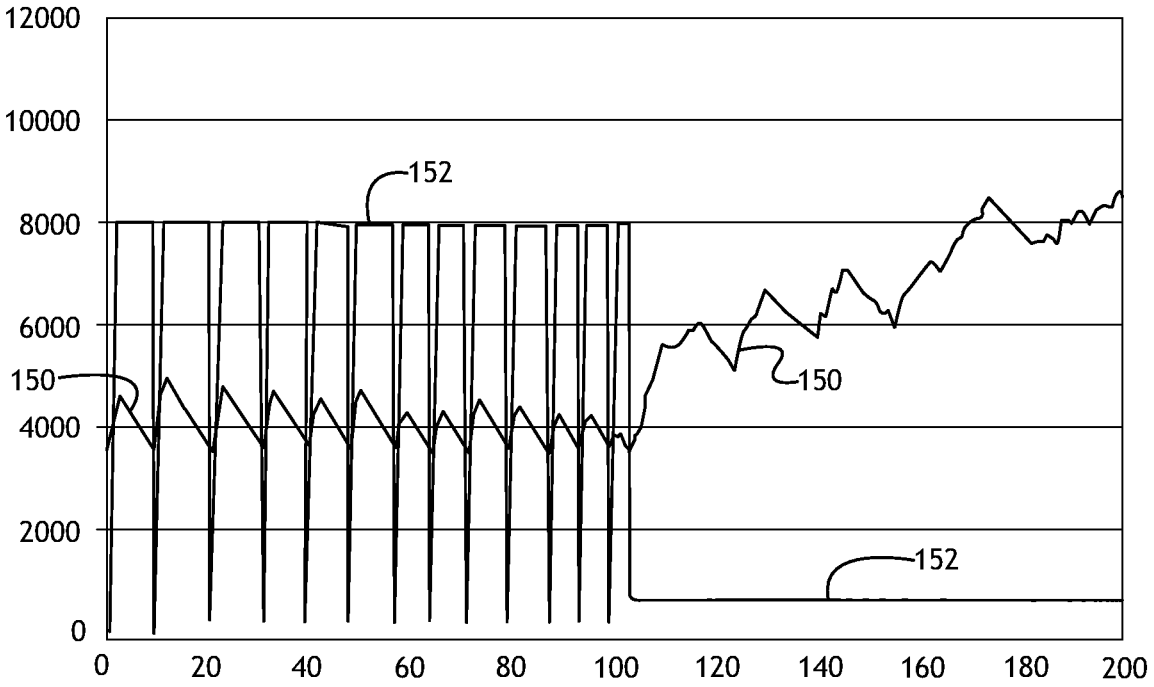
FIG. 7 is a graph showing engine speed and an engine mode indicator.
Figure 8:
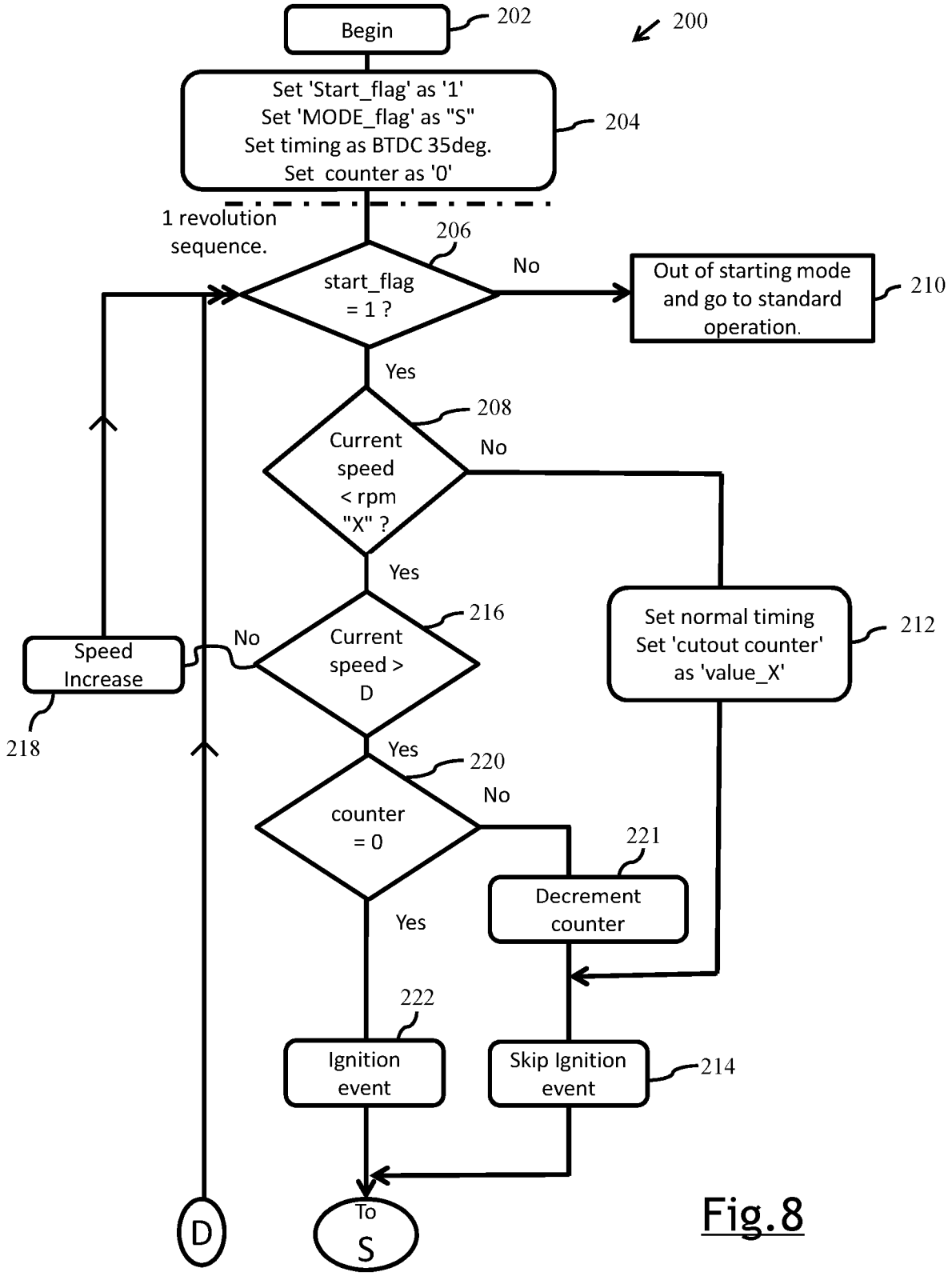
FIGS. 8-12 are flowcharts of a method for controlling an engine.

FIG. 7 shows a plot of rpm (line 150) during start mode speed limiting and after start mode is terminated by detection of the throttle valve in the wide open position. Also plotted is a mode indicator line 152 which shows ignition events and revolutions for which no ignition event occurs. For example, during the first revolution on the graph, an ignition event occurs and the rpm increases from the governed speed of about 3,500 rpm (i.e. the second threshold) to about 4,500 rpm. For the next 9 revolutions, no ignition event occurred because the engine speed remained above the second threshold and the engine speed declined over these revolutions until the engine speed was again at or below the second threshold at about revolution 10. The speed reduction counter would have a value of 9 at this point in the method. In revolution 10, an ignition event again occurred, and the engine speed increased up to about 5,000 rpm. The speed reduction counter would also have been reset to zero and the value would be stored in the buffer as noted above. Over the next 11 cycles no ignition event occurred as the engine speed remained above the second threshold. The speed reduction counter would now have a value of 11. This general pattern repeated several times over the course of the test (which shows about 12 ignition events), with varying engine speeds and revolutions without an ignition event, until it was determined that the throttle was in the wide open position at about revolution 105, and the speed governing was terminated (i.e. the second threshold was removed, and the third threshold was implemented). The engine speed then increased over the next 95 or so revolutions from about 3,500 rpm to about 8,500 rpm.

The method previously explained is of an embodiment, and is intended to include variations which would be obvious to one skilled in the art. For instance, the values for engine speed used to determine the flow of control for the system could be an average engine speed calculated over a predetermined number of engine revolutions instead of a single reading. Also, the predetermined engine revolution values used for comparison could be modified to take into account various engine performance, environmental, and other considerations. Furthermore, the spark that initiates the combustion process may be generated by methods other than with a capacitive discharge ignition (CDI) system, such as a "flyback" type ignition system that provides a primary winding with sufficient current and suddenly halts the current such that the surrounding electromagnetic field collapses, thereby producing a high voltage ignition pulse in the secondary winding. And while the speed limiting was disclosed with regard to skipping one or more ignition events, at least some implementations may limit speed in other ways, for example by changing an air and fuel mixture delivered to the engine or by changing the timing of the ignition, or both. Further, these alternate engine speed reduction controls may be implemented in combination with skipped ignition event control. For example, if the alternate controls do not satisfactorily slow the engine, then a subsequent ignition event could be skipped so that multiple controls are used to control engine speed.

FIGS. 8-12 illustrate a method 200 of operating an engine to limit engine speed below a first threshold, which may be a clutch-in speed of a centrifugal clutch as set forth above. Although method 200 is described below in the context of a fast idle start-up operating sequence—i.e., a stand-alone operating sequence specifically designed to warm up the engine by operating it at speeds between idle and wide open throttle (WOT)—it should be appreciated that the method could be part of a different stand-alone operating sequence or it could be integrated into a larger operating sequence, to cite a few possibilities. In the description that follows, the clutch-in speed will be assumed to be 4,500 rpm, which represents the first threshold. Of course, the first threshold could be less than the clutch-in speed or some other speed, as desired.

The method 200 begins at 202 upon starting or cranking of the engine, and may begin within the first or second passage of the flywheel magnets past the windings of the control system 12. The power induced in the control system 12 by the magnets wakes up or powers up the electronic processing device 60. The processing device 60 may determine piston position, for example a top dead center (TDC) position of a piston in the engine. This may be done, for example, by using data from the pulses induced in the windings and/or the time between consecutive pulses. In one implementations, the pulses may be about 355 degrees apart or about 5 degrees apart. The processing device, during the process of powering or booting up, can determine where TDC is by looking at the differences in the spacing between the voltage spikes caused by the passing of the south and north poles of the magnet. If two spikes are close together they are from a single passing of the magnet. If they are further apart, then they are likely a trailing pole from one revolution and the leading pole of the next revolution. The noted orientations are representative, but not limiting as TDC can be determined from other pulse patterns. For example, the smaller spacing may be as high as 90 degrees rather than 5 degrees as noted in the implementation above, because of the way that the flux lines fan out from the actual magnet edges. So long as there is a notable difference between the close voltage spikes (e.g. 90 degrees) and the farther apart spikes (e.g. 270 degrees). When the processing device senses or is provided with a minimum voltage, the processing device controls ignition timing for the first combustion event. In at least some implementations, sufficient voltage may be generated at an engine speed of 500 rpm or more. When the processing device is sufficiently powered and operating, the method continues to step 204.

In step 204, a starting mode flag is set to an initial value, such as '1' to indicate that the starting mode has been initiated. An engine operating mode flag may be set to a desired value, such as 'S' in the illustrated example (which may represent a starting mode). A counter may be set to an initial value, such as '0' in the illustrated example. Finally, an initial ignition timing may also be set in step 204. In at least some implementations, the initial ignition timing may be chosen to cause the engine to accelerate which may facilitate continued engine operation and inhibit the engine from stalling. In one embodiment, the ignition timing may be advanced significantly from an initial timing for the first ignition event to a new timing. In some embodiment, the initial timing upon starting the engine may be at or just before TDC while the advanced timing set in step 206 may be between 20 and 40 degrees before TDC (BTDC), with one representative implementation at 35 degrees BTDC.

With the ignition timing set, the method continues to 206 wherein it is determined if the starting mode flag is at the value set in 204 (e.g. '1'). This ensures that the starting mode method should be implemented or continued, and that the engine has not been running for a period of time such that the starting mode method is not needed or desired. If the starting mode flag is at the initial value, then the method continues to step 208. If the starting mode flag is not at the initial value, then the method 200 is terminated at 210.

In step 208 the current engine speed is compared to at least a second threshold which is less than the first threshold. In this example, the second threshold is less than the clutch-in speed and may be between about 3,000 rpm to 4,000 rpm. If the current engine speed is greater than the second threshold, the method moves to steps 212 and 214 wherein operations may be undertaken to reduce the engine speed because the engine is running faster than desired. As noted above, this may be done in one or a combination of ways including, but not limited to, changing the ignition timing, skipping an ignition event, and changing the air:fuel ratio of a mixture delivered to the engine. In this example, the ignition timing is returned to a normal ignition time in step 212, that is, the advancement in ignition timing from step 204 is reduced or eliminated. The counter may also be set to a first value which may be greater than zero, such as between 5 and 10 which, as will be seen later, will ensure that the method 200 continues for at least a certain number of engine revolutions after this higher speed engine is detected to ensure the engine speed stabilizes below the first threshold or some other desired threshold. In step 214, an ignition event is skipped (i.e. an ignition event for the next engine revolution, which is shown in step 222 is skipped) to avoid accelerating the engine and allow the engine speed to decrease. From step 214, the method proceeds to step 224 which will be described later.

If in step 208 the engine speed was less than the second threshold, the method may optionally proceed to step 216 wherein the engine speed is compared to a third threshold which may be less than the second threshold. In at least some implementations, the third threshold is a low limit speed threshold below which the engine might not operate steadily and may be likely to stall. In this example, the third threshold may be between about 0 rpm and 500 rpm, although other values may be used as desired. If the engine speed is not greater than the third threshold, the method continues to step 218 in which one or more steps may be performed to increase the engine speed, or at least steps are not taken to reduce engine speed. Increasing the engine speed may be done by any suitable means, including, but not limited to, changing the ignition timing, the air:fuel ratio of a mixture delivered to the engine, or both. In at least some implementations, the ignition timing may remain in the advanced state set in step 204, or it may be changed. Again, steps 216 and 218 are optional. After step 218, the method may proceed to step 206 to again check the engine speed against the second threshold at step 208. If in step 216 the engine speed is greater than the third threshold, the method continues to step 220.

If in step 220 the counter is not at the initial value (e.g. zero) the method continues to step 221 in which the counter value is decreased (e.g. by one) and then the method proceeds to step 214 in which the ignition event for this engine revolution is skipped. If in step 220 the counter is at the initial value (e.g. zero) the method continues to step 222 in which an ignition event occurs which usually results in increased engine speed. The method then proceeds to step 224 which is in the subroutine shown in FIG. 9. Accordingly, if optional steps 216 and 218 are included, then the engine speed steps may be undertaken even if the counter is not at zero, in an attempt to maintain operation of the engine which is for some reason operating at very low speed and near stalling. Otherwise, if the engine speed is above the third threshold, then the next ignition event can be skipped if the counter is not at zero because the counter is only set above zero when the engine has achieved a high enough speed that skipping an ignition event is not likely to result in an engine stall.

Figure 9:
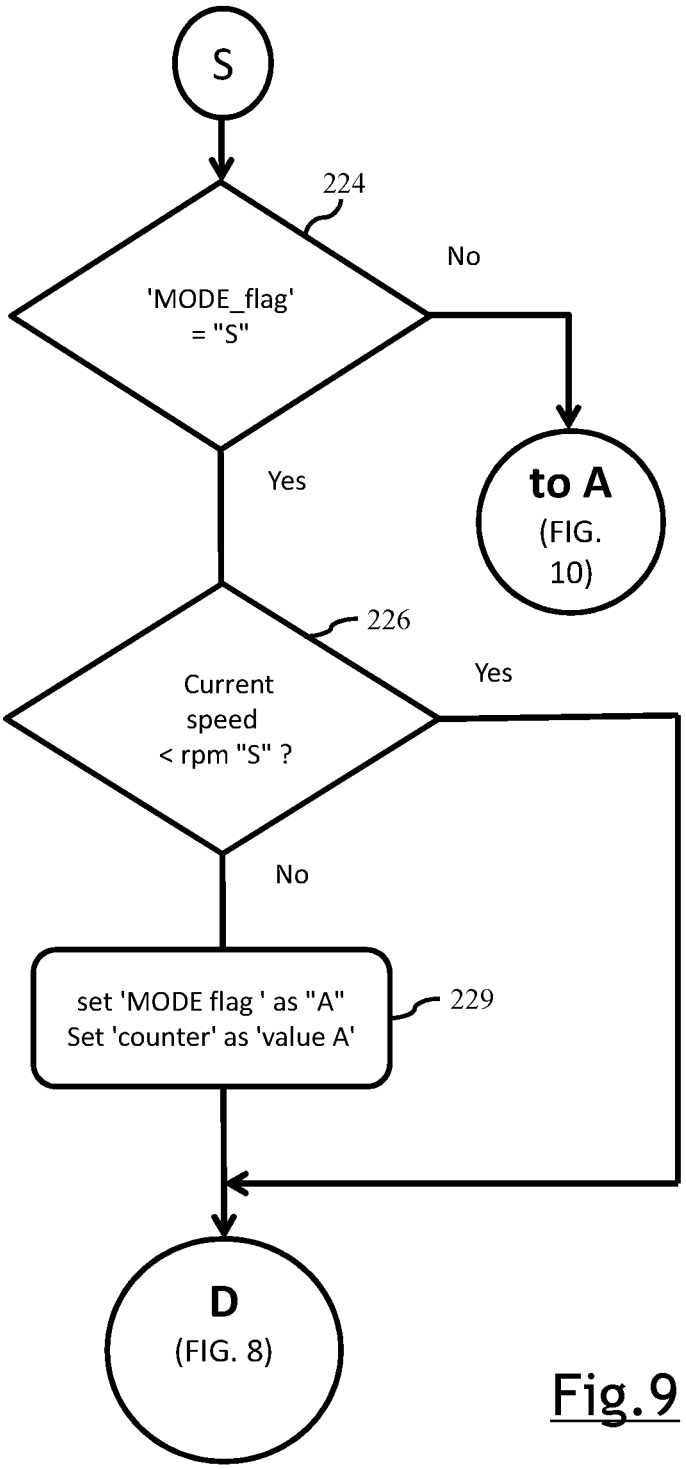

As shown in FIG. 9, in step 224 it is determined if the engine operating mode flag is at the initial value (i.e. 'S' in the illustrated example). If the operating mode flag is set at the initial value, then the method proceeds to step 226 in which the engine speed is compared to at least one threshold. In the illustrated example, the engine speed is compared to at least a fourth threshold. The fourth threshold may be any desired value or range of values and may be used to determine if the engine speed is greater than desired. For example, the fourth threshold may be between 3,000 rpm and 4,000 rpm or it could be a set value such as 3,500 rpm. This speed may represent a fast-idle engine speed that may be used to facilitate warming up a recently started cold engine, this speed may be greater than a normal idling speed of the engine that occurs during normal engine operation. If the current engine speed is less than the fourth threshold, the method may return to step 206. If the current engine speed is not less than the fourth threshold, the method proceeds to step 229 in which the operating mode flag is set to a second value or variable different than the initial or first value that was set in step 204. In the illustrated example, the operating mode flag is set to 'A'. Further, the counter may be set to a desired second value which may be greater than zero, for example, between 5 and 30. This ensures that the method continues for several more revolutions so that the engine speed may be further checked before the method ends. The counter set in step 229 may be the same as the counter previously mentioned, or it may be a separate counter, as desired. Then, the method returns to step 206.

Figure 10:
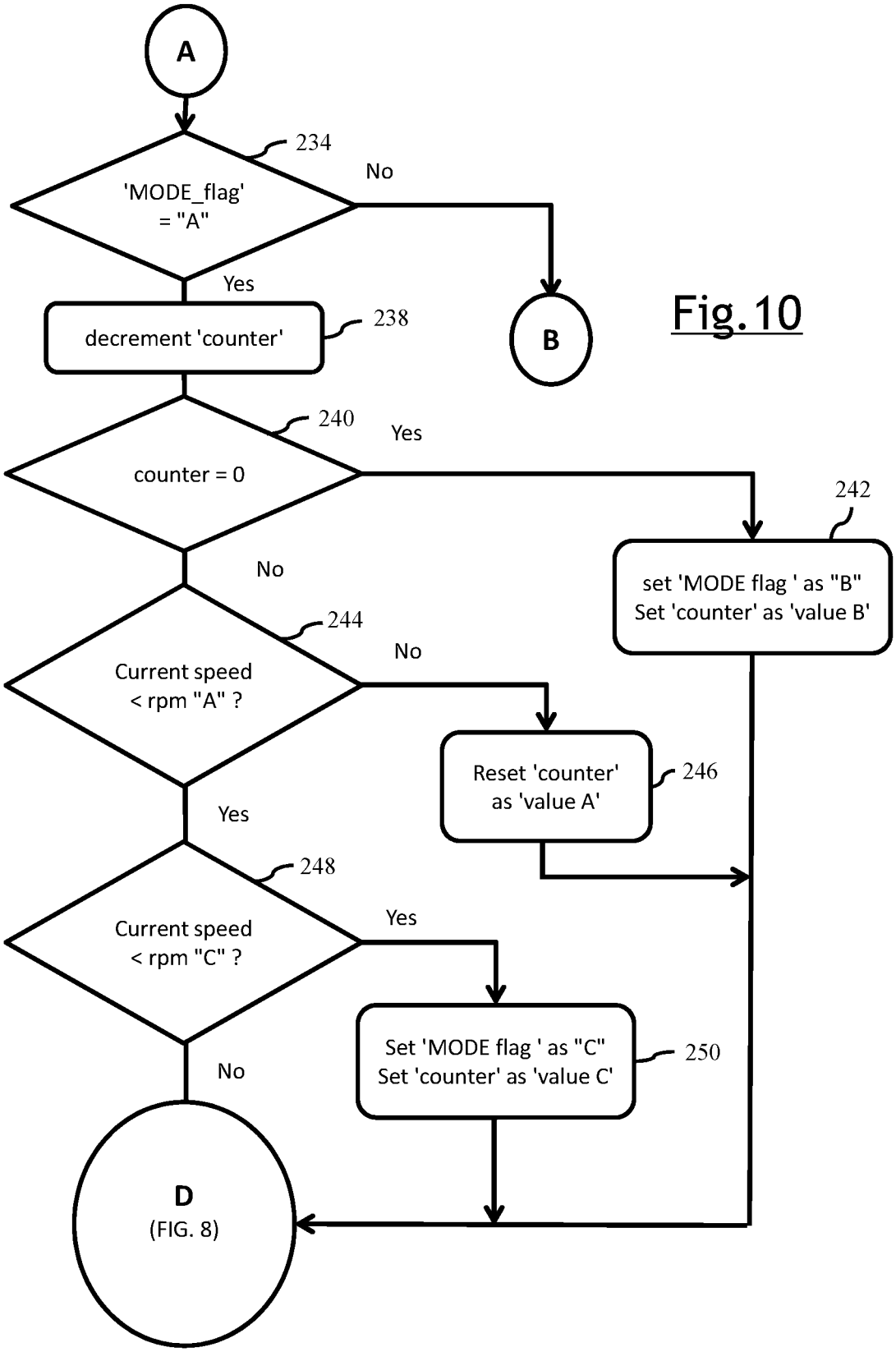

If in step 224 it is determined that the operating mode flag is not set to the initial value (e.g. 'S'), then the method proceeds to step 234 in the subroutine shown in FIG. 10. If in step 234 the operating mode flag is not equal to the second value established in step 229 (e.g. 'A'), then the method proceeds to step 236 in the subroutine shown in FIG. 11, which will be described later. If in step 234 the operating mode flag is equal to the second value established in step 229 (e.g. 'A'), then the counter is decremented (i.e. the counter value is reduced by one) in step 238 and the method continues to step 240.

If in step 240 the counter value equals zero, the method proceeds to step 242 wherein the operating mode flag is set to a desired third value or variable which may be different than the first and second values (and is shown as 'B' in the illustrated example). Further the counter value may be set to a desired third value, which may be greater than zero. In the illustrated example the counter may be set in step 242 to a value between 5 and 30, but other values may be used as desired. Thereafter, the method returns to step 206 as described above (and because the start flag is still at '1', the method would continue to step 208 for further engine speed analysis).

If in step 240 the counter value does not equal zero, the method continues to step 244 in which the engine speed is compared to a fifth threshold. In the illustrated example, the fifth threshold may be between 3,000 rpm and 4,000 rpm, although other values or ranges of values may be used. If the engine speed is not less than the fifth threshold, then the method continues to step 246 in which the counter value is set to a desired value, which may be the same as the value chosen in step 229, or it may be different. The method may thereafter return to step 206.

If in step 244 the engine speed is less than the fifth threshold, then the method continues to step 248 wherein the engine speed is checked against a sixth threshold. The sixth threshold may represent a normal engine idling speed which occurs during normal engine operation and may be less than the fast idle speed noted above. In the illustrated example, the sixth threshold is between 2,400 rpm and 3,200 rpm although other values may be used. If the engine speed is less than the sixth threshold, the method proceeds to step 250 in which the operating mode flag may be changed to a fourth value or variable (e.g. 'C' in the illustrated example) and the counter may also be set to a fourth value which may be different than or the same as one or more of the first, second and third counter values. After step 250 the method returns to step 206 as described above. If in step 248 the engine speed is not less than the sixth threshold, the method proceeds to step 206.

Figure 11:
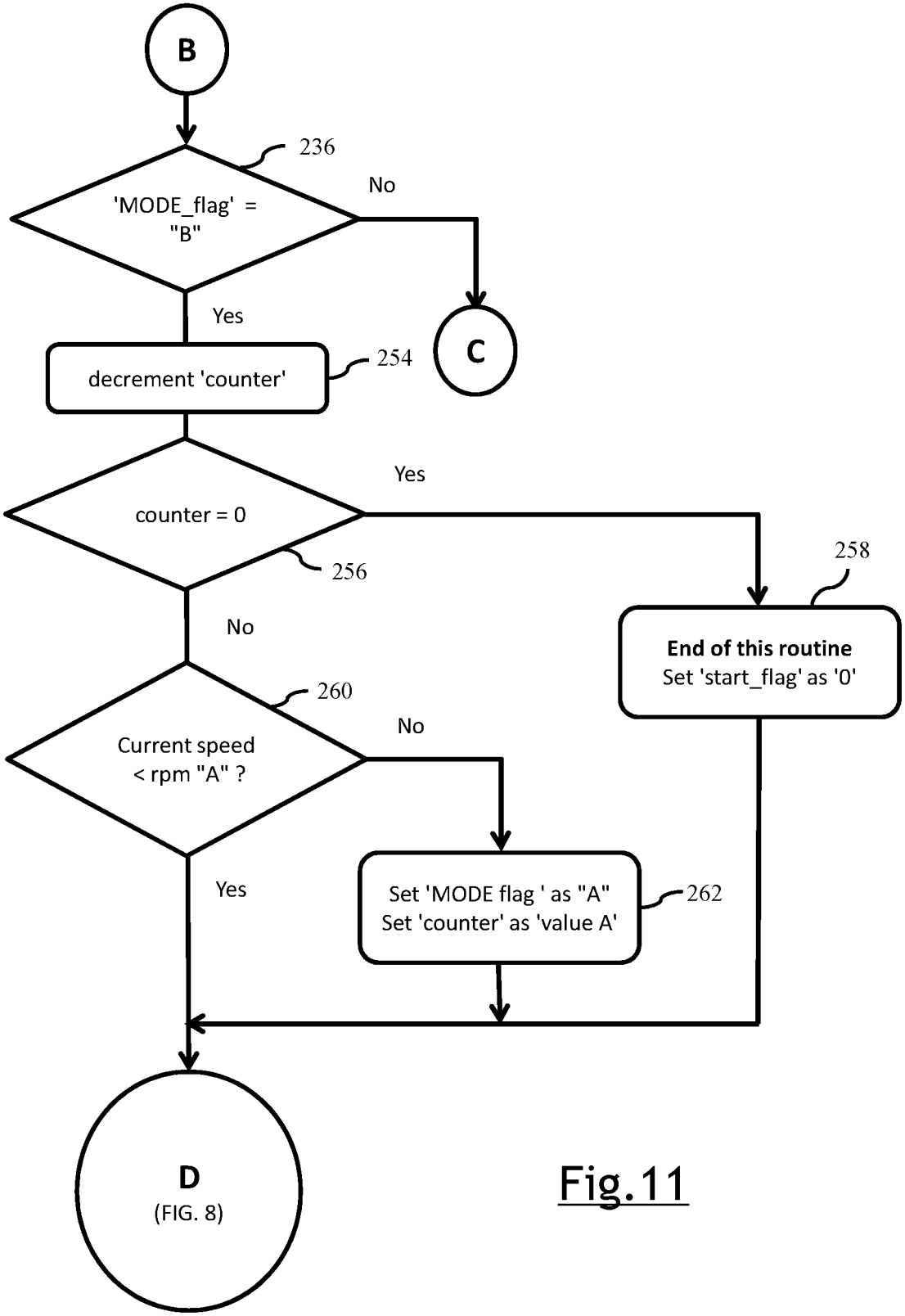
Figure 12:
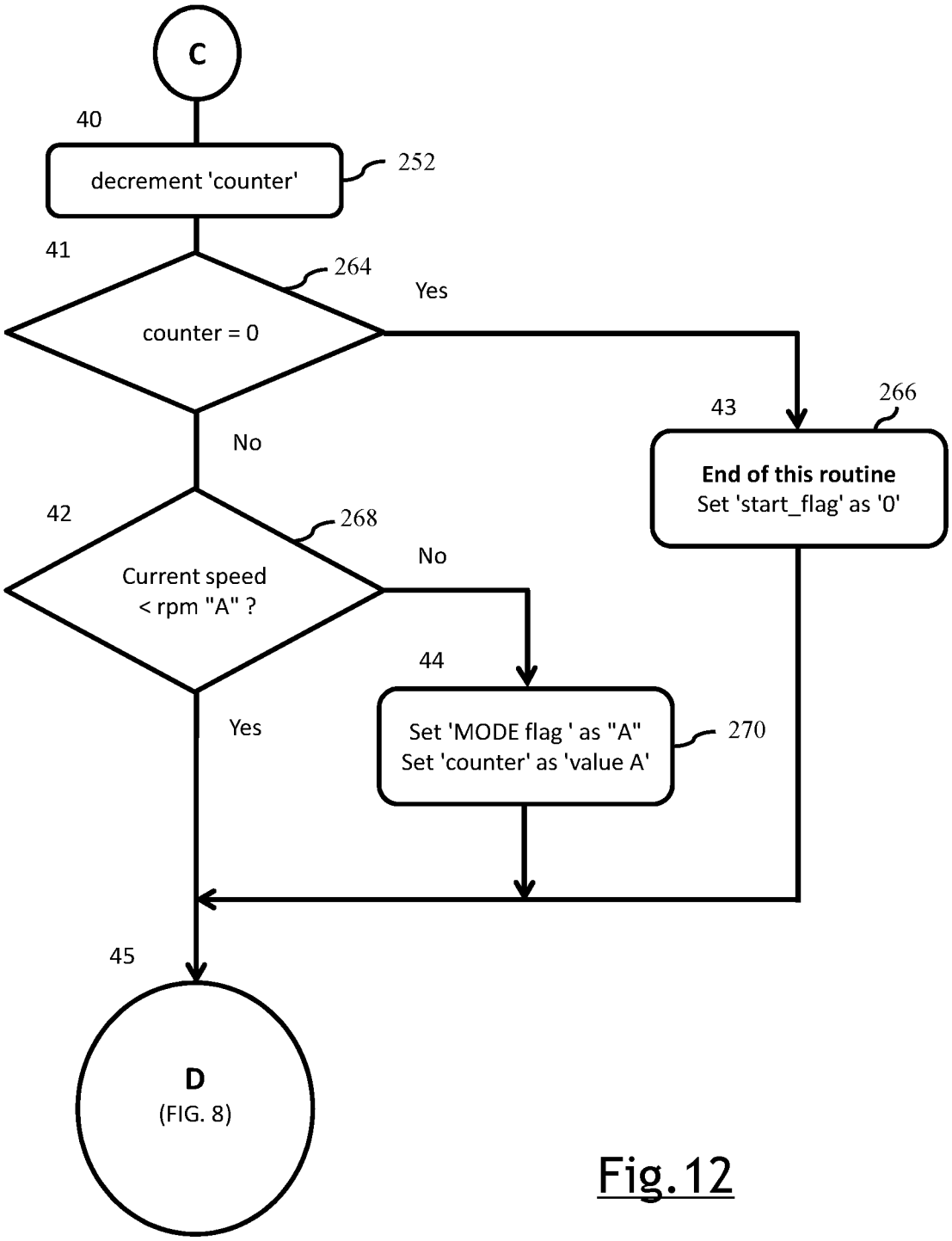
Figure 13:
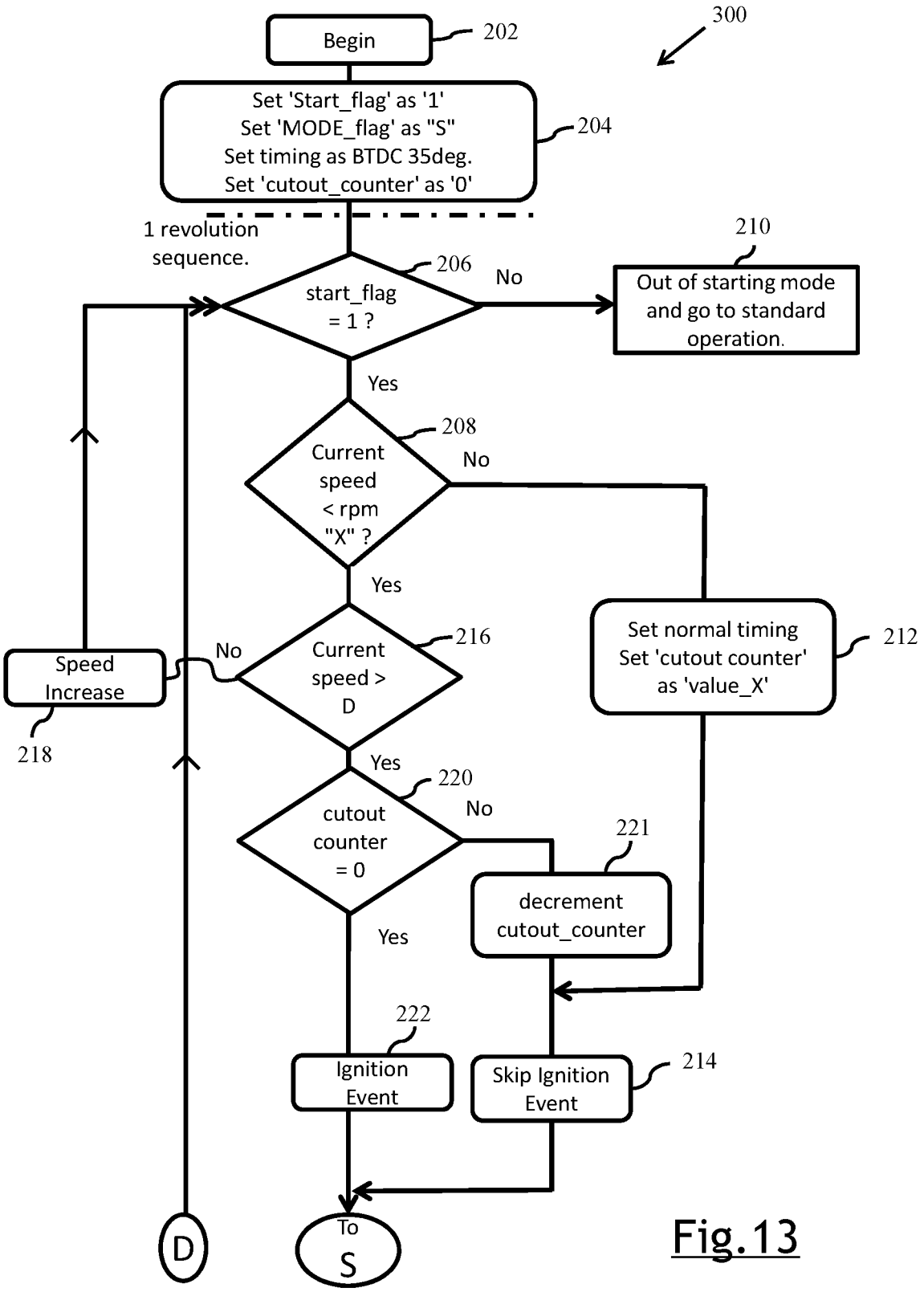
FIGS. 13-17 are flowcharts of a method for controlling an engine.
Figure 14:
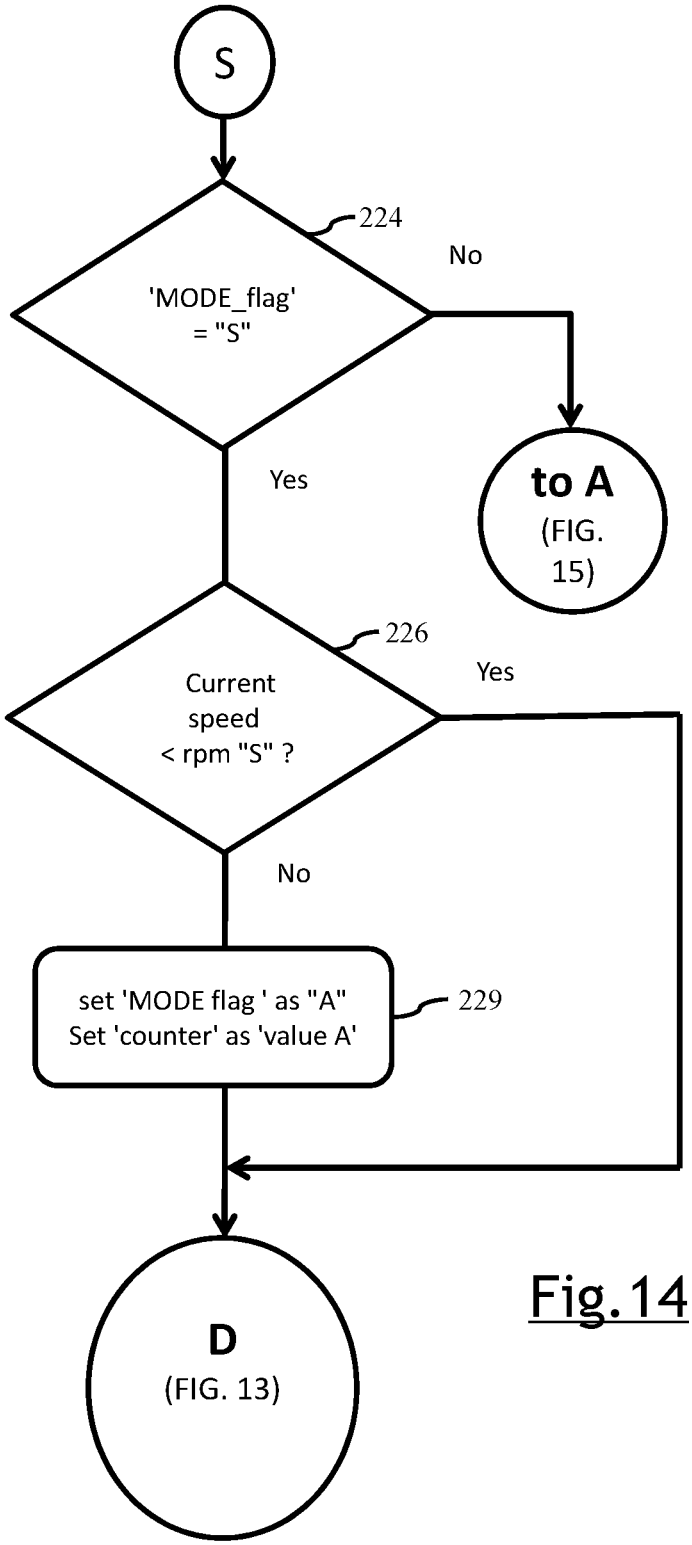
Figure 15:
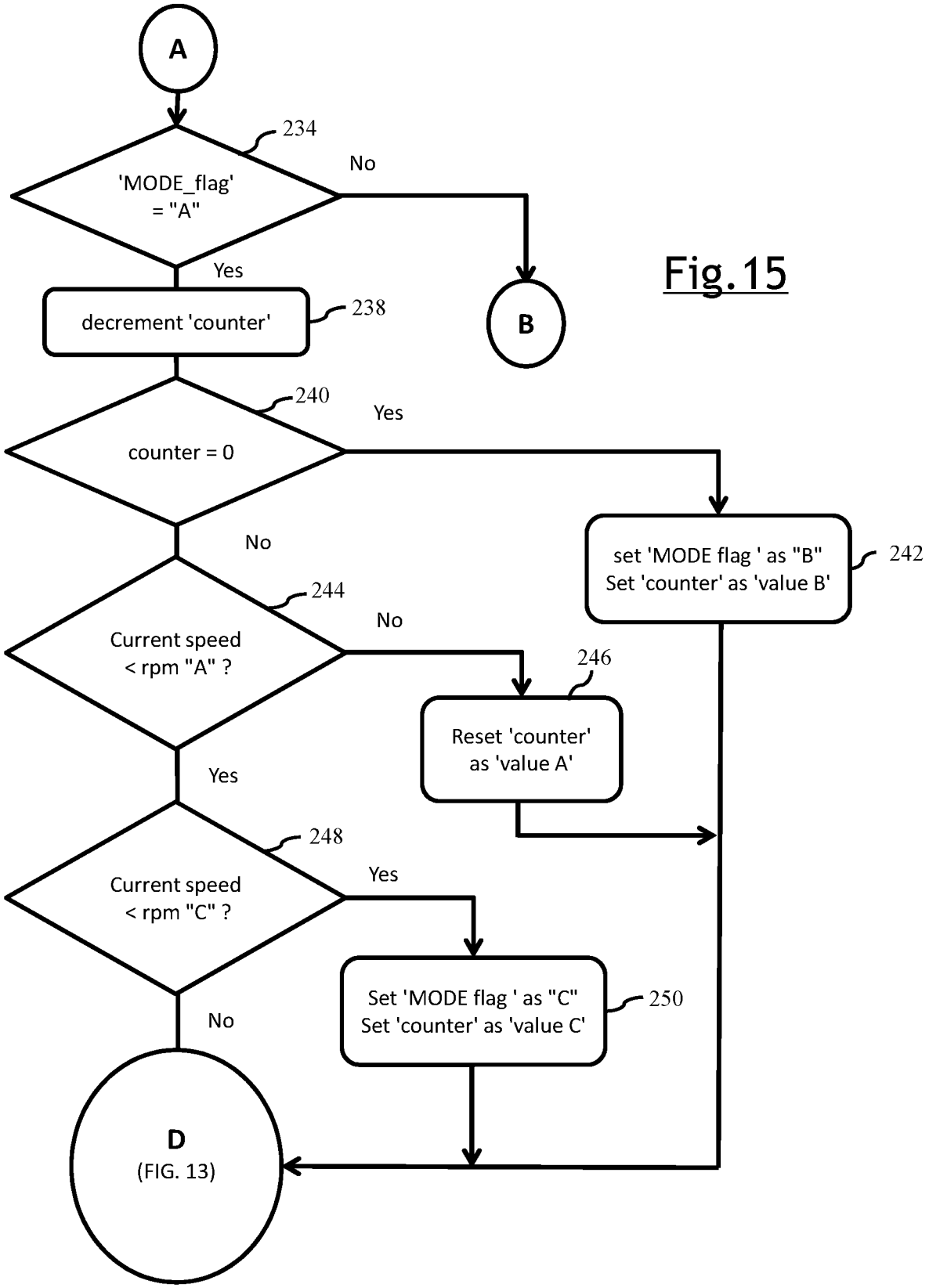

As shown in FIG. 11, the subroutine begins at step 236 wherein if the operating mode flag is not set to the third value or variable (e.g. 'B' in the illustrated example), then the method proceeds to step 252 shown in FIG. 12, and if it is, then the method proceeds to step 254. In step 254, the current counter value is decreased (e.g. by one) and the method proceeds to step 256. In step 256, if the counter value is equal to zero (e.g. the counter has been fully decremented) then the method proceeds to step 258 in which the starting mode flag is set to a second value (e.g. zero in the illustrated example) and thereafter the method proceeds to step 206 and thereafter to step 210 wherein the method ends. In step 256, if the counter value is not equal to zero, then the method proceeds to step 260. If in step 260 the speed is less than the fifth threshold, the method returns to step 206. If the speed is greater than the fifth threshold, the method proceeds to step 262 in which the operating mode flag is set to a desired value or variable, which may be the second value or variable ('A' in the illustrated example), and the counter is set to a desired value, which may be the second counter value. Thereafter, the method returns to step 206.

The subroutine of FIG. 12 begins at step 252 wherein the counter value is decreased (e.g. by one) before the method continues to step 264. In step 264, if the counter value is equal to zero (e.g. the counter has been fully decremented) then the method proceeds to step 266 in which the starting mode flag is set to a second value (e.g. zero in the illustrated example) and thereafter the method proceeds to step 206 and thereafter to step 210 wherein the method ends. In step 264, if the counter value is not equal to zero, then the method proceeds to step 268. If in step 268 the speed is less than the fifth threshold, the method returns to step 206. If the speed is greater than the fifth threshold, the method proceeds to step 270 in which the operating mode flag is set to a desired value or variable, which may be the second value or variable ('A' in the illustrated example), and the counter is set to a desired value, which may be the second counter value. Thereafter, the method returns to step 206.

As shown and described, the method 200 may include several checks of the engine speed against multiple thresholds. If the engine speed is higher than desired, then steps may be taken so that the engine speed is decreased. One or more counters may be used to ensure that the engine speed remains below a desired speed, or within a desired speed range, for a certain number of consecutive engine revolutions. At least during initial engine operation, the engine speed may vary considerably from one revolution to the next, so having the engine speed checks conducted over a series of consecutive revolutions can ensure a desired engine operating stability. This can reduce the likelihood that the engine speed will suddenly or unexpectedly increase above a threshold after an ignition event. Once the method has run its course, the engine operation can be controlled in accordance with normal engine control schemes, and may permit user throttle actuation to increase the engine speed as desired.

An alternate starting mode method 300 is set forth in FIGS. 13-17. This method 300 may be similar in many ways to method 200 and similar steps may be given the same reference number to facilitate description of method 300. For example, method 300 may be the same as method 200 with regard to steps 200 to 250 shown in FIGS. 8-11. As such, FIGS. 13, 14 and 15 may be the same as FIGS. 8-10.

Figure 16:
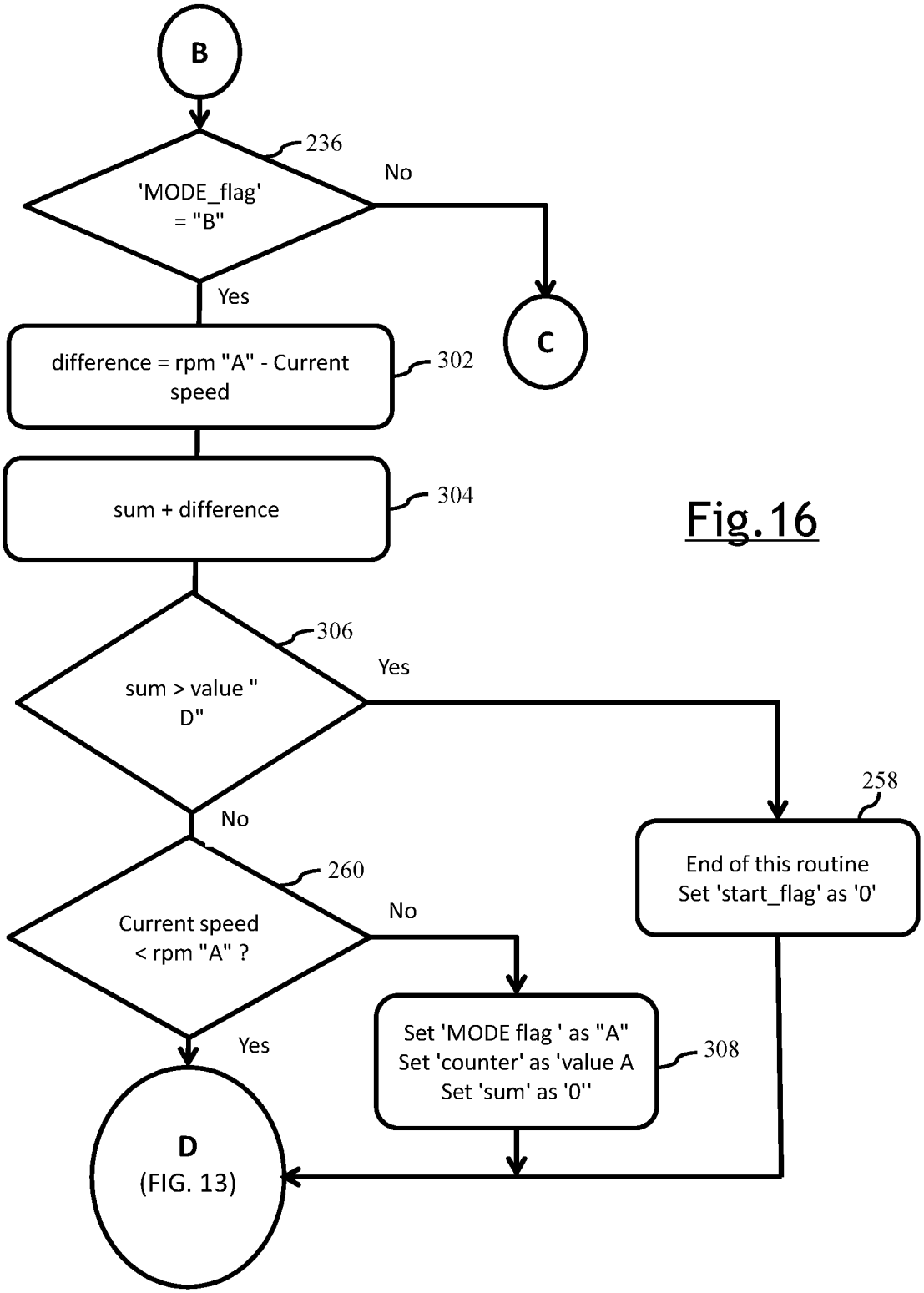

As shown in FIG. 16, if in step 236 it is determined that the operating mode is set to the third value (e.g. 'B' in the illustrated embodiment) the method 300 proceeds to step 302 in which the difference between the fifth threshold and the current engine speed is determined and stored in memory. In step 304, the difference determined in step 302 is added to the difference determined in any previous iterations of step 302 during the same engine operating sequence—the sum value stored in memory or buffer used is preferably reset to zero each time the engine is started, which may be done, for example, in step 204. The method then proceeds to step 306 in which the sum value from step 304 is compared against a seventh threshold. If in step 306 it is determined that the sum value is not greater than the seventh threshold, then the method proceeds to step 260. If in step 306 it is determined that the sum value is greater than the seventh threshold, then the method proceeds to step 258 wherein the starting mode flag is set to zero before the method returns to step 206 which will cause the method to end at step 210 as noted above. This may be done because the sum value is at a high enough value which indicates that the engine is operating sufficiently below the fifth threshold for one or more consecutive cycles that the starting mode is no longer needed. The seventh threshold may be any desired value and, in at least some implementations, is a value high enough that several summed values (obtained by going through steps 302 and 304 several times) are required to exceed the seventh threshold—in other words, the difference determined in step 302 in any one iteration is preferably less than the seventh threshold. In the illustrated example, the seventh threshold is set between 15,000 and 30,000 rpm.

In step 260 if it is determined that the current engine speed is not less than the fifth threshold, then the method proceeds to step 308. In step 308, like step 262, the operating mode flag is set to the second value (e.g. 'A') and the counter is set to the second counter value. Also in step 308, the sum value may be reset to zero. Thus, each time the engine speed is greater than the fifth threshold, the sum value may be reset. This may ensure a desired engine speed stability for a number of consecutive engine revolutions before the starting mode flag is set to zero and the method is terminated, by ensuring that the engine remains below the fifth threshold for a number of consecutive engine revolutions. The number of consecutive engine revolutions needed to exceed the seventh threshold will vary as a function of how much less than the fifth threshold the engine speed is during each revolution. For example, where the seventh threshold is set to 19,800 rpm, 40 consecutive revolutions at an average speed of 500 rpm less than the fifth threshold will be needed before the sum value in step 304 will exceed the seventh threshold. Thus, instead of decrementing a counter by one no matter the magnitude of the difference between the fifth threshold (or some other threshold) and the current engine speed, the method 300 requires greater number of revolutions be less than the threshold the closer the engine speed is to the threshold and fewer number of revolutions if the engine speed is farther away from that threshold and the first threshold. This indicates that the engine is not likely to greatly accelerate in the next revolution and achieve a speed over the first or second threshold such that normal engine control method(s) may be employed to keep the engine speed in a desired range.

Figure 17:
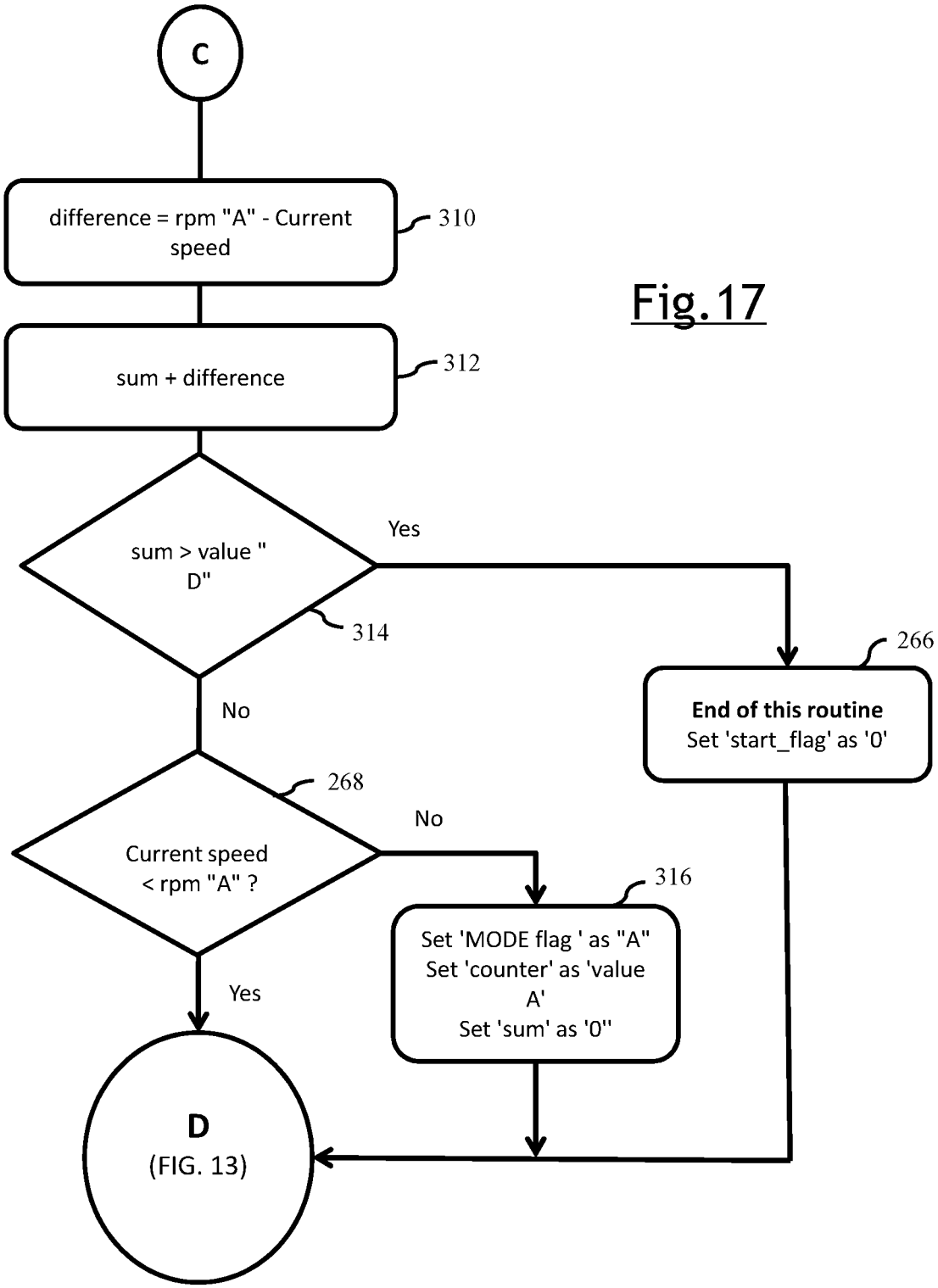

A similar scheme may be employed in the subroutine shown in FIG. 17. Instead of decrementing a counter and checking to see if the counter value is at zero as was done in steps 252 and 264, the method 300 may, in step 310 determine the difference between the fifth threshold and current engine speed, add that in step 312 to the value in a buffer or memory and compare the sum value from step 312 against a seventh threshold in step 314. If the sum value is greater than the seventh threshold, the method may proceed to step 266 in which the starting mode flag is set to zero and the method is thereafter terminated. If the sum value is not greater than the seventh threshold, then the method proceeds to step 268 which may be the same as step 260. Step 316 may be the same as step 308 previously described (and hence, like step 270 with the addition of resetting the sum value to zero).

Figure 18:
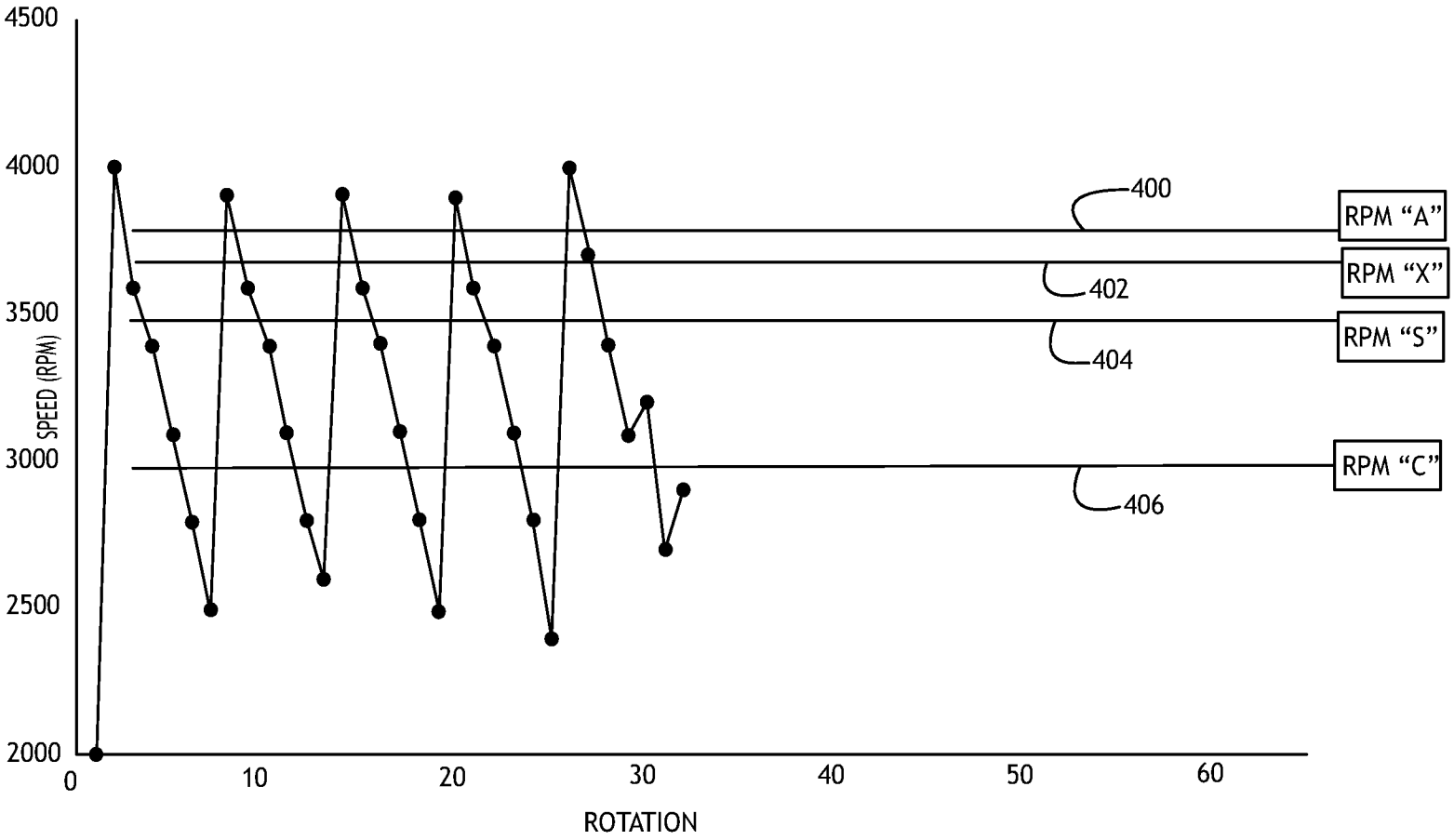
FIG. 18 is a graph of engine speed over a number of engine revolutions and showing a number of representative thresholds that may be used in controlling an engine.

FIG. 18 is a graph of engine speed over a number of engine revolutions. In this example, the fifth threshold is denoted by line 400, the second threshold is denoted by line 402, the fourth threshold by line 404, and the sixth threshold by line 406. The third threshold is not shown in this graph because the lowest speed shown on the graph is above the third threshold in this example. In the illustrated example, the fifth threshold is greater than the second threshold which is greater than the fourth threshold which is greater than the sixth threshold, although other relationships among the thresholds may be used. In the illustrated example, the fifth threshold is set at about 3,800 rpm, the second threshold is set at about 3,700 rpm, the fourth threshold is set at about 3,450 rpm and the sixth threshold is set at about 2,950 rpm. However, as noted above, other implementations may utilize different thresholds. For example, in at least some implementations, the fourth threshold may be greater than the second threshold, and the second threshold may be the same as or greater than the fifth threshold. Of course, other implementations and relationships may be used.

In the graph, the speed for each revolution is noted by a plot point (i.e. a dot) and engine speed is graphically represented by a line between the plot points of consecutive revolutions. Significant increases in speed from one revolution to the next are due to an ignition event, and a decrease in speed between revolutions is because there was no ignition event from the one revolution to the next, to reduce the engine speed. For the purposes of describing FIG. 18, the speed increases and reductions will be attributed to ignition events, although as noted above, other speed increasing or speed reducing steps may also or instead be undertaken to control engine speed. As shown in FIG. 18, each ignition event can increase the speed, at least in this example, by over 1,000 rpm and in some instances over 1,500 rpm. However, without an ignition event (and/or due to some other speed reduction step), the engine slows less than that, about 200 to 400 rpm in this example. Therefore, multiple consecutive ignition events must be skipped in order to reduce the engine speed to a level wherein an ignition event will not cause the engine speed to exceed the first threshold. In at least some implementations, an ignition event does not occur until the engine speed has dropped below the sixth threshold, which may be less than the first threshold by an amount greater than the maximum speed increase in the engine from a single ignition event (at least within the engine speed range contemplated in this starting mode method). In this example, the sixth threshold is set more than 1,500 rpm less than the first threshold, for example, at 2,950 rpm where the first threshold is 4,500 rpm.

To achieve the engine speed reduction in this way, the counter (or counters if multiple counters are used) may be used to prevent engine ignition for a certain number of consecutive engine revolutions. The counter may be set to a value that is a function of the engine speed so that a faster engine speed results in a higher counter value and a greater number of successive cycles with a skipped ignition events. In the example graph of FIG. 18, the first revolution was at 2,000 rpm and an ignition event occurs which resulted in the second revolution speed of 4,000 rpm. That speed is greater than all of the illustrated thresholds and so a counter was established so that the next 5 revolutions occurred without an ignition event. This resulted in the 7th revolution being at about 2,500 rpm. Another ignition event then occurred and the 8th revolution was at a speed of about 3,900 rpm, which again established a counter so that the next 5 revolutions occurred without an ignition event resulting in the 13th revolution being at about 2,600 rpm. This pattern continued and is plotted out to revolution 32 in FIG. 18. Accordingly, the thresholds and counter values can be set for a particular implementation (e.g. according to the characteristics of a particular engine) to provide a desired engine speed control.

The descriptions above is generally set forth with regard to a two-stroke engine wherein each revolution is a cycle. The methods 200 and 300 may also be used with a four-stroke engine in which each cycle includes two revolutions. Here, the ignition events occur every other revolution unless they are skipped as set forth above. Further, a four-stroke engine may slow down more from cycle-to-cycle when ignition events are skipped and so the counter values and thresholds may be adjusted as desired.

Figure 19:
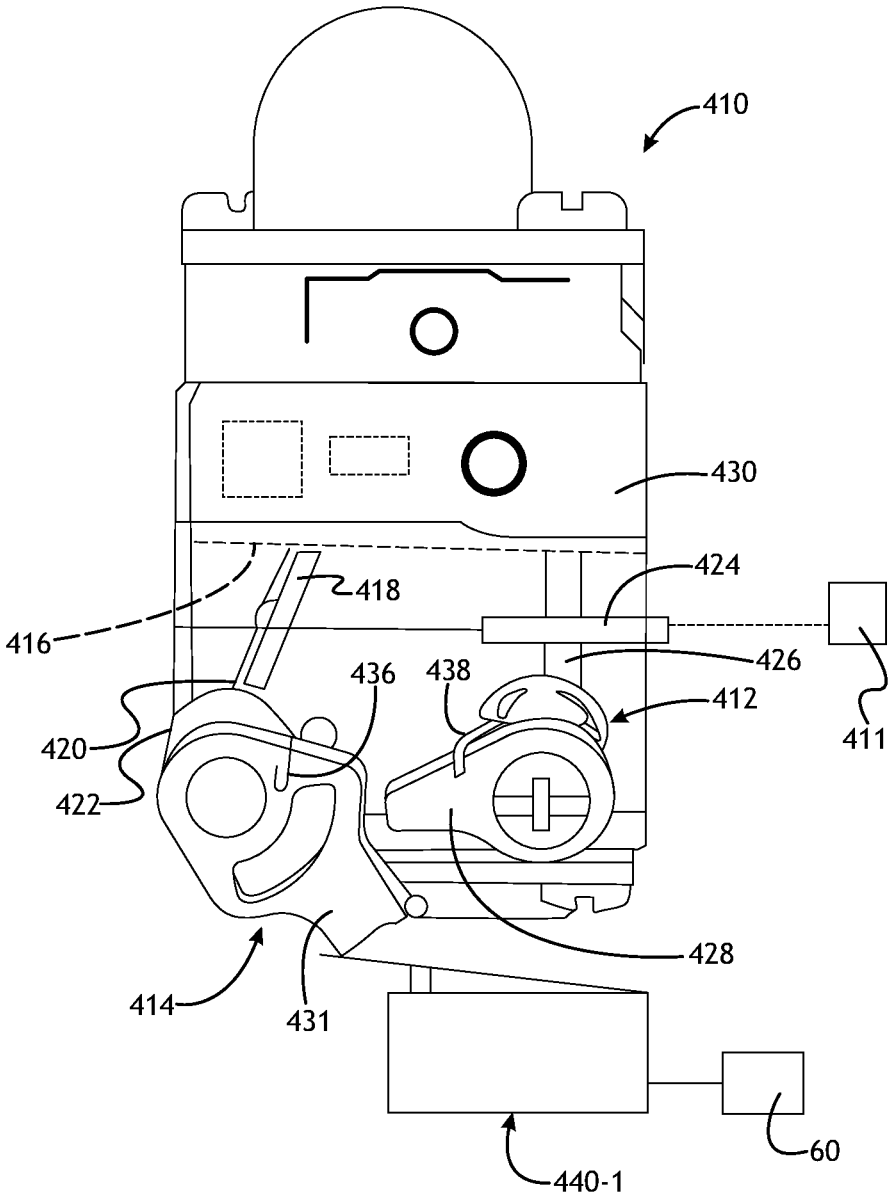
FIG. 19 is a side view of a charge forming device.
Figure 20:
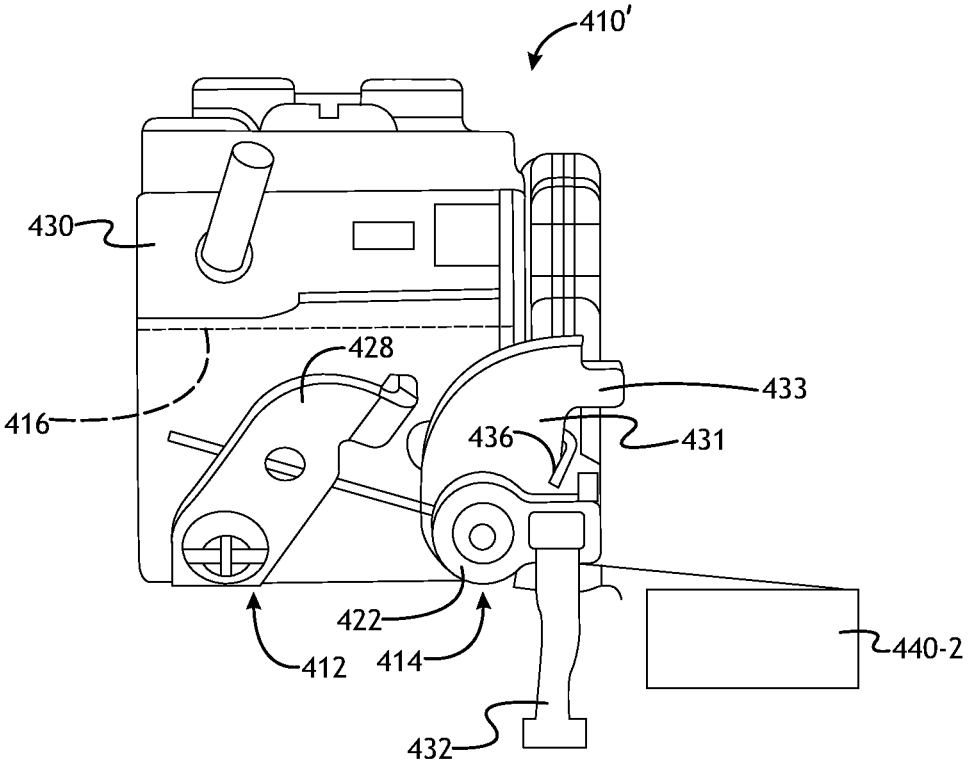
FIG. 20 is a partial side view of a charge forming device.

FIGS. 19 and 20 illustrate two versions of a charge forming device 410, 410' from which a fuel and air mixture is delivered to an engine 411. The features relevant to the below discussion may be common among the devices 410, 411 so only the device 410 will be described unless specific reference is made to FIG. 20. For ease of description and understanding, components in the device 410' that are the same as or similar to components in the device 410 will be given the same reference numerals in FIG. 20 as in FIG. 19.

The charge forming device has a throttle valve 412 and may also have a choke valve 414 (parts of both are diagrammatically illustrated in FIG. 19) both of which control at least part of the fluid flow through a main bore 416 to control the flow rate of a fuel and air mixture to the engine 411. The choke valve 414 may be a butterfly type valve having a valve head 418 within or adjacent to the main bore 416, a rotatable shaft 420 to which the valve head is connected and a choke valve lever 422 coupled to the shaft to facilitate rotating the choke valve shaft in known manner. Levers 422 may be provided on or adjacent to one or both ends of the shaft 420. The throttle valve 412 may also be a butterfly valve, by way of a non-limiting example, having a throttle valve head 424 within or adjacent to the main bore 416 and spaced from the choke valve head 418, a rotatable throttle valve shaft 426 to which the throttle valve head is connected and a throttle valve lever 428 coupled to the throttle valve shaft to facilitate rotating the throttle valve shaft. In known manner, the throttle valve 412 (e.g. via the lever 428) may be linked to a throttle valve actuator (e.g. a manually operable trigger or switch) by a suitable cable (e.g. a Bowden cable).

To vary the air flow through the main bore 416, the throttle valve 412 may be actuated and movable between a first or idle position and a second or wide open throttle position in response to actuation of the trigger (for example). In general, the flow area, which is defined between the throttle valve 412 and a body 430 of the charge forming device 410 that defines the main bore 416, may be at a maximum when the throttle valve is in the wide open position and the flow area may be at a minimum when the throttle valve is in the idle position. The throttle valve lever 428 may include or be engaged by one or more other levers or components to control actuation of the choke valve 414 (if provided), and/or to temporarily hold the throttle valve 412 in a position between the idle and wide open positions. In one example, the throttle valve 412 may be held in a position off-idle to cause the engine to run at a fast-idle speed. As noted above, the fast-idle engine operation may be useful to facilitate warming up a cold engine and maintaining initial engine operation (e.g. avoiding a stall). As shown in FIG. 20, a fast-idle lever 431 may be associated with the choke valve 414 to selectively engage the throttle valve 412 and move the throttle valve off its idle position to an intermediate or start position. In summary, rotation of the choke valve 414 to its closed position may cause the fast-idle lever 431 to engage the throttle valve lever 428 and rotate the throttle valve to the intermediate position. Rotation of the choke valve back to its open position will disengage the fast-idle lever 431 from the throttle valve lever 428 and permit the throttle valve to move to its idle position without interference from the fast-idle lever. Rotation of the throttle valve toward its wide open position may also disengage the throttle valve lever 428 from the fast-idle lever 431, and the choke valve may automatically (e.g. under force of a spring) rotate back to its open position, thereby removing the fast-idle lever from the path of movement of the throttle valve lever 428. Lever arrangements to hold a throttle valve in an intermediate or third position between the idle and wide open positions are taught in U.S. Pat. Nos. 6,439,547 and 7,427,057, the disclosures of which are incorporated herein by reference in their entirety.

In at least some implementations, a starting procedure for an engine may include moving the throttle valve 412 to an intermediate position associated with fast-idle or other off-idle engine operation, and purging and/or priming the charge forming device 410 in known manner. The throttle valve 412 may be moved to the desired position by moving a handle or lever coupled to the throttle valve lever 428, the choke valve lever 422 (which in turn engages the throttle valve lever to rotate the throttle valve) or by directly manipulating the throttle valve lever. In some systems, a solenoid or other powered actuator may be used to move the throttle valve, if desired.

As shown in FIG. 20, a handle or start lever 432 coupled to the choke valve 414 is moved from a first, unactuated position to a second, actuated position to move the choke valve from its open position to its closed position. During this movement, the fast-idle lever 431 engages the throttle valve lever 428 and moves the throttle valve 412 from its idle position to the intermediate position. A first biasing member 436 may be coupled to or provide a force on the choke valve and/or start lever 432 to provide a force tending to return the choke valve and/or start lever to its unactuated position. A second biasing member 438 may act on the throttle valve 412 tending to rotate the throttle valve to its idle position. The biasing force on the throttle valve 412 may be used to maintain the throttle valve lever 428 engaged with a stop surface 433 on the fast-idle lever 431 that is moved into the path of movement of the throttle valve lever when the start lever 432 is actuated. The force of this engagement may also hold the start lever 432 in its actuated position (and optionally also the choke valve 414 in a closed or starting position), against the force of the first biasing member 436 on the start lever. Subsequent actuation of the throttle valve 412 by a user, e.g. by actuating a trigger, moves the throttle valve lever 428 away from the fast-idle lever 431 whereupon the start lever 432 may return under the force of the first biasing member 436 to or toward its unactuated position (and optionally the choke valve 414 may move to its open position). The biasing member 438 acting on the choke valve/start lever may be a biasing member directly associated with the choke valve tending to keep the choke valve open unless the start lever is pulled/actuated. In the unactuated position, the fast-idle lever 431 is not within the path of movement of the throttle valve lever 428 and the fast-idle lever no longer interferes with movement of the throttle valve lever. In this way, the fast-idle engine operation can be terminated automatically upon actuation of the throttle valve 412.

In at least some implementations, the operating speed of the engine is limited, at least upon starting the engine, and perhaps also during initial warming up of the engine. In some implementations, the speed may be limited to a speed below a clutch-in speed of a tool associated with the engine, for example, a chain of a chain saw. This prevents the chain from being actuated during staring and initial warming up of the engine, and until the throttle valve 412 is actuated by a user to begin operation of the chain. When the throttle valve 412 is actuated, the user's hands are usually in proper position on the chainsaw (e.g. two switches, one actuatable by each hand, may be required to enable actuation of the trigger and thereby ensure, within reason, the position of the user's hands). However, in some implementations, such as set forth herein, the engine speed is limited not only by throttle valve position but also by control of the ignition timing and/or number of ignition events that occur (e.g. some ignition events are skipped to control engine speed). Accordingly, actuation of the throttle valve 412 by the user may not result in the engine speed increasing, at least to the extent desired by the user, if these other controls are still active.

In order to determine when the throttle valve 412 has been actuated, a sensor, switch or other detection element 440 may be used. In at least some implementations, the detection element 440 is associated with the fast-idle lever 431 or start lever 432 and/or a component used to actuate or move the start lever 432. For example, a switch 440 may be in a first state when the start lever (or other component) is in a first position and the switch may be in a second state when the start lever (or other component) is in a second position. Movement of the start lever 432 (or other component) may directly engage the switch 440 and change the state of the switch, as desired. In FIG. 19, the fast-idle lever 431 coupled to the choke valve 414 engages the switch 440-1 (where the "–1" indicates a first version of a switch 440 which is diagrammatically shown). In FIG. 20, another version of a switch 440-2 is shown and is actuated by the choke valve (e.g. lever 422) or by the start lever 432. In at least some implementations, the first state of the switch 440 is open and the second state is closed. Further, the first position of the start lever 432 (or other component) may be the actuated position associated with fast-idle engine operation, that is, when the start lever 432 is engaged with the throttle valve 412 to hold the throttle valve in an intermediate, off-idle position. And the second position of the start lever 432 (or other component) may be the unactuated position associated with normal throttle valve movement, as set forth above. Accordingly, the switch 440 may be open unless the start lever 432 or other component is in its actuated position.

Thus, the switch 440 can be used to determine if the start lever 432 is in its actuated position or not. At least in implementations wherein actuation of the throttle valve 412 releases the start lever 432 and causes the start lever to move from its actuated state to its unactuated state, the change in switch state from closed to open can be used to determine that the throttle valve has been actuated. This information, in turn, may be used to terminate at least some engine speed governing processes, for example, ignition timing changes or ignition event skipping designed to control or reduce engine speed below a threshold (e.g. clutch-in speed). Of course, the switch 440 can be otherwise arranged (e.g. the first state may be closed and the second state may be open), a sensor may be used instead of a switch to detect start lever movement (e.g. magnetically sensitive sensor, an optical sensor or other type sensor).

The switch or sensor may be coupled to or otherwise associated with a microprocessor, controller or other processing device (e.g. device 60 as noted above) which may control one or more of the processes noted above, including engine speed control and/or control of the ignition system to enable termination of engine speed reduction or control as noted herein, as a function of the state of the switch.

Figure 21:
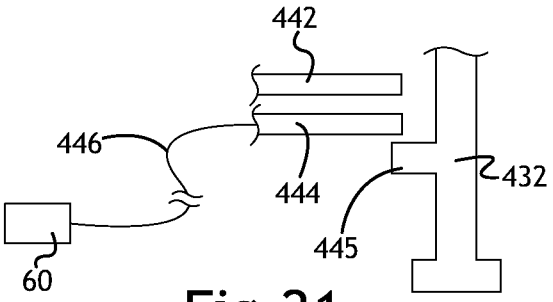
FIG. 21 is a diagrammatic view of a detection element.

The switch 440 may be a toggle switch that is moved between two positions by movement of the start lever or other component. The switch 440 may also be inexpensively and simply implemented as two conductors 442, 444 (FIG. 21) which may be simple pieces of metal (e.g. spring steel) that have a portion (e.g. free ends) adjacent to each other and either moved together (e.g. by a tab 445 on start lever 432) to complete a circuit path (e.g. close the switch) or moved apart or permitted to move apart to open a circuit path (e.g. open the switch). The conductors 442, 444 may be electrically communicated with the microprocessor or other controller or circuit, as desired. In at least one form, a wire 446 may be connected to one conductor 444 and to the microprocessor 60 or some part of the circuit that is coupled to the microprocessor. The conductors 442, 444 may be flexible so that they flex when engaged by the start lever or other component to engage each other, and the conductors may be resilient to return toward their unflexed or unbent positions and thereby disengage from each other when not forced against each other, which is a normally open arrangement. The conductors 442, 444 may also be arranged in a normally closed position and then separated by or in response to movement of the start lever or other component, if desired. Movement of at least one component in response to disengagement of the start lever caused by actuation of the throttle valve 412 is thus detected by a switch, sensor or other detection element 440 to enable deactivation of an engine speed control process or system.

Figure 24:
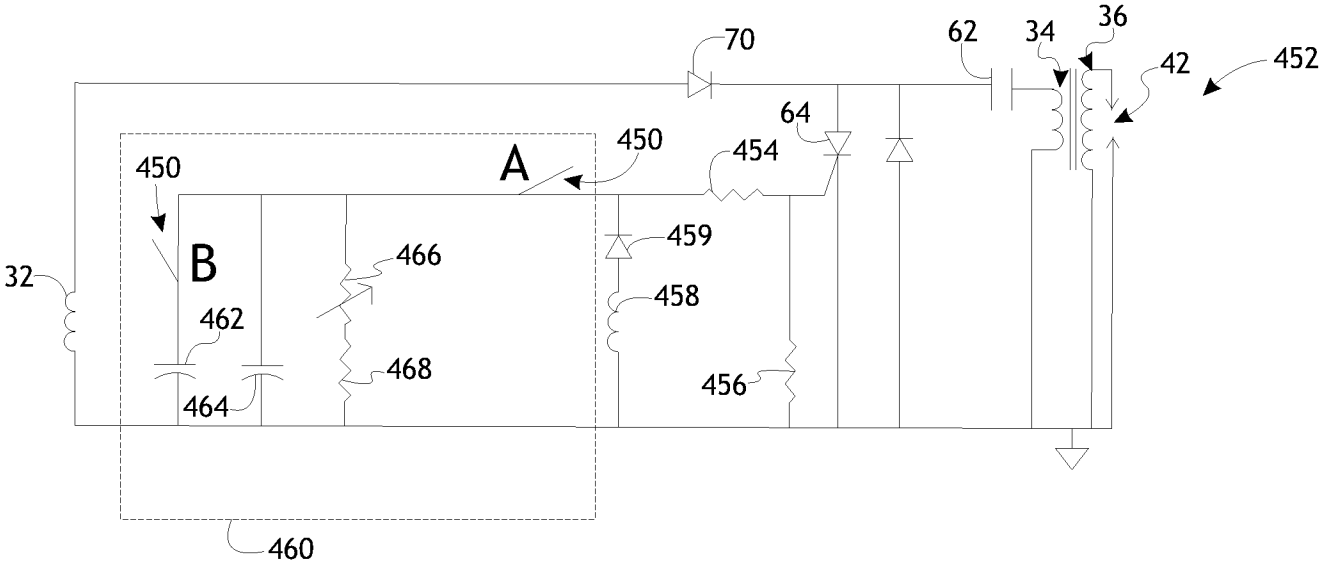
FIG. 24 is a schematic diagram of part of an ignition circuit including two switches providing analog speed governing options.

As shown in FIG. 24, a switch 450 may be located in one of two positions (denoted as A and B) and may provide analog speed control. In FIG. 24, a portion of an ignition circuit 452 is shown. The portion shown includes charge winding 32, primary ignition winding 34, secondary ignition winding 36, spark plug 42, ignition discharge capacitor 62, switch 64, and diode 70 which may be arranged and function as set forth above. The circuit may also include resistors 454, 456 that bias the switch 64, a trigger winding 458 that provides a signal to the switch 64 once per engine revolution to cause an ignition event and a diode 459.

To control the engine speed, the circuit 452 may include a speed governing subcircuit 460. The subcircuit 460 includes the switch 450 and one or more capacitors (two capacitors 462, 464 are shown) that are arranged to hold the switch 64 on or conductive longer than it would be without the capacitor(s). When the switch 64 is on or conductive, charge is not built up in the charge capacitor 62 and in at least some implementations, an ignition event in one or more subsequent engine revolutions may not occur. The skipped ignition events can then be used to limit or control the engine speed. In the implementations shown, the subcircuit 460 also includes a thermistor 466 and a resistor 468 in series, which provide a variable total resistance that is dependent upon temperature. As is known in the art, the resistors 466, 468 provide temperature compensation so that the subcircuit operates in a more stable and desired manner across a range of temperatures, to account for changes in the conductivity of the switch 64 and/or other semiconductors in the circuit.

In more detail, when the switch 450 is in position A, the switch shown in position B and the capacitor 462 are not needed and can be omitted. Switch 450 may be normally closed, and when closed, the capacitor 464 may be charged by the charge winding 458 via diode 459 which prevents reverse current flow through the charge winding (and prevents the capacitor(s) 462, 464 from discharging through the coil). The charge on the capacitor 464 is communicated with the switch 64 via resistor 454 and holds the switch 64 in its conductive state for a certain duration of time. When the duration of time is long enough to prevent a subsequent ignition event, the engine speed is limited, reduced or controlled in part by the subcircuit 460. At higher engine speeds, a lesser time duration is needed to cause a skipped ignition event and at lower engine speeds, a longer time duration is needed to cause a skipped ignition event. Therefore, the components can be calibrated to provide a desired duration of time in which the switch 64 is held on or conductive by the capacitor 464 to provide an engine speed limiting or control at a desired engine speed.

In at least some implementations, the speed limiting may be set to a threshold that is less than a clutch-in speed of the engine. In such implementations, the switch 450 may be closed when a fast idle lever is engaged with a throttle valve as set forth above, to provide the desired engine speed control during a fast idle engine operating mode. When the fast idle lever moves in response to movement of the throttle valve or otherwise, such that the fast idle engine operating mode is terminated, the switch 450 may be opened. When the switch 450 is opened, the capacitor 464 no longer communicates with the charge winding 458 or the switch 64 and, hence, there is no speed limiting provided by the capacitor 464.

When the switch 450 is provided in position B and the switch 450 is open, the capacitor 464, thermistor 466 and resistor 468 may provide temperature compensated speed control as set forth above. When the switch 450 is closed, another capacitor 462 provides charge to hold the switch 64 on or conductive longer than without the capacitor 462. In this way, the engine speed control may be effective at lower engine speeds when the switch 450 is closed than when the switch 450 is open. In at least some implementations, the switch 450 may be normally closed and the switch may be closed during the fast idle engine operating mode, and the switch 450 may be opened when the fast idle engine operating mode is terminated. Hence, during fast idle engine operating mode the engine speed may be limited further, such as below a clutch-in speed (e.g. 4,000 rpm to 4,500 rpm). And when fast idle engine operating mode is terminated, the engine speed control may be set, for example, to a maximum desired engine speed (e.g. 10,000 rpm or higher). In this way, more than one level of engine speed control may be provided to enable speed control during different engine operating modes.

Figure 22:
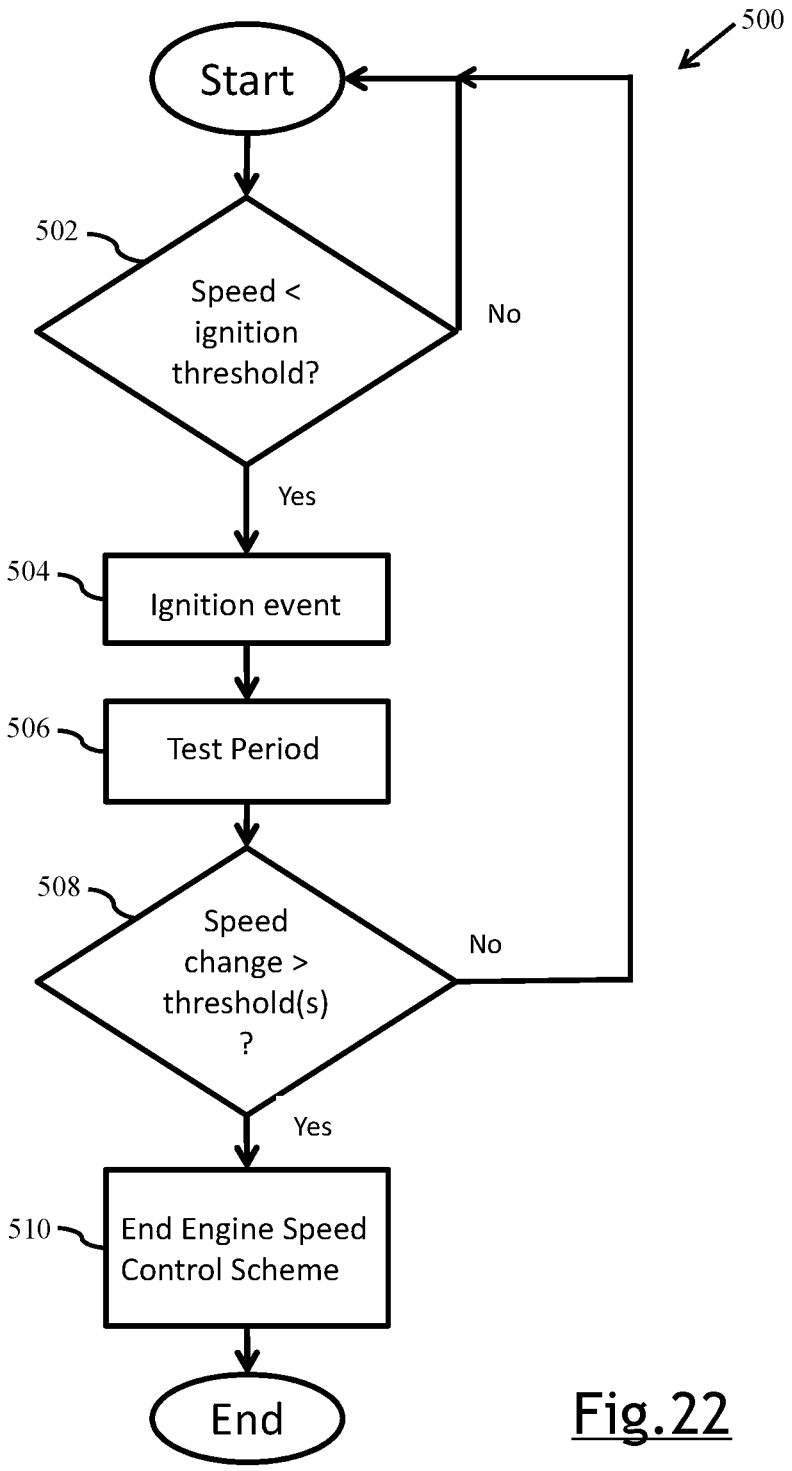
FIG. 22 is a flowchart of a method for controlling an engine.

In another method 500 as shown in FIG. 22, during a period of time in which engine speed governing or control is being performed, actuation of the throttle valve by a user may be detected by, in a test period, temporarily disabling the engine speed control, determining the engine speed change during the test period and comparing the engine speed during the test period with a threshold engine speed change value or range of values. The threshold speed change may be chosen as a function of expected engine operation over the test period without throttle valve actuation so that an engine speed change greater than the threshold indicates throttle valve actuation. The speed change may be a speed change for any given engine revolution within the test period compared to a prior revolution (e.g. a revolution before the test period such as, but not limited to, the last revolution before initiation of the test period, the first revolution in the test period), or for more than one revolution within the test period including up to all of the revolutions within the test period. The speed change may be an actual calculated speed change or averaged or filtered over one or more and up to all of the engine revolutions in a given time frame (e.g. the test period).

A speed change greater than the threshold may be caused by increased fuel and air delivered to the engine and ignited during a combustion event. The increased fuel and air delivered to the engine is a result of the throttle valve being actuated from the starting position (e.g. fast-idle) to a position of greater throttle valve opening up to and including WOT. Thus, detection of a greater engine speed change than would occur if the throttle valve remained in the starting position, indicates that a user actuated the throttle valve and intends to take control of the engine operation.

Further, during the test period or other period in which the engine speed control is disabled, additional ignition events may be permitted that would not occur with the engine speed control enabled or active. In one non-limiting example, when engine speed control is active, an ignition event may be permitted once for many revolutions, e.g. ten. In general, each ignition event will increase the engine speed. Thus, more ignition events in a given time period will generally result in greater engine speed than fewer ignition events in the same time period.

In an example in which the engine speed is maintained below a maximum speed threshold by an engine speed control scheme, the engine speed must be significantly below the maximum speed threshold before an ignition event occurs or an ignition event will cause the engine speed to exceed the threshold. The magnitude of engine speed increase from a given ignition event will depend upon a number of factors, at least some of which are: 1) type of engine; 2) fuel mixture available for combustion (e.g. richness of the fuel/air mixture); 3) timing of ignition event; and 4) the duration of the ignition event (e.g. duration of a spark that causes combustion of the fuel mixture). Accordingly, during engine speed control, the ignition events may be skipped until the engine speed is below an ignition threshold, where the ignition threshold is sufficiently below the engine maximum speed threshold so that an ignition event will not cause the engine to exceed the engine maximum speed threshold. By way of one non-limiting example, if an engine speed increase under certain conditions may be up to 1,000 rpm, then the ignition threshold may be set 1,000 rpm or more below the desired engine maximum speed threshold. In at least some implementations, when the engine speed control is active, no ignition events will occur unless the engine speed is at or below the ignition threshold.

As noted above, in one non-limiting example, the engine speed may remain above the ignition threshold for about ten revolutions after an ignition event, and then another ignition event may occur on the $11^{th}$ revolution. In such a system, additional fuel and air may be delivered to and accumulate in the engine combustion chamber(s) during revolutions that do not include an ignition event. Hence, an ignition event may involve more fuel and air than if an ignition event occurred during each revolution (in a two-stroke embodiment, or each engine cycle in a four-stroke embodiment). An ignition event involving additional fuel and air may cause additional engine speed increase compared to an ignition event involving less fuel and air. The ignition threshold may be set taking into account the variability in engine performance, ignition timing and other factors to control engine speed below the desired maximum speed when engine speed control is active.

To help determine if the throttle valve has been actuated, additional ignition events are permitted during the test period than would otherwise occur in the engine speed control scheme. In at least some implementations, an ignition event may be provided during each engine cycle and during part or all of the test period. Of course, other schemes may be used including an ignition event every other cycle or every third cycle, etc., and the ignition events may be provided at irregular intervals as well. In at least some implementations, the additional ignition events during the test period are not sufficient to increase the engine speed above the engine maximum speed threshold of the engine speed control scheme unless the throttle valve has been actuated. Accordingly, the number of engine cycles within the test period and the number of ignition events within the test period may be tailored to a given engine and application. While providing additional ignition events will increase the engine speed, the amount of the combustible fuel mixture in the engine is less when ignition events occur more frequently (for a given throttle position and/or engine speed), so the speed increase is less for each of the more frequent ignition events than for a less frequent ignition event, such as is provided in at least some implementations of the engine speed control scheme. Thus, the system can be tailored to provide additional ignition events without exceeding the engine maximum speed threshold of the engine speed control scheme when the throttle valve has not been actuated.

However, when the throttle valve has been actuated more toward its wide open position than the fast-idle position, the amount of the combustible fuel mixture available for each ignition event is increased. Thus, when the throttle valve has been actuated toward its wide open position from its position upon starting the engine (e.g. fast idle), the engine speed may increase by an amount greater than if the throttle valve has not been actuated. In at least some implementations and situations, the engine speed may exceed the engine maximum speed threshold and in others, it might not, depending upon one or more factors such as the length of the test period, number of ignition events and extent of throttle valve actuation toward its wide open position. Exceeding the engine maximum speed threshold may be acceptable in at least some implementations because this occurs when the throttle has been actuated by a user which indicates that the user is ready to use the tool associated with the engine.

In at least some implementations, the test period is initiated when the engine speed is below a threshold or otherwise far enough below the engine maximum speed threshold so that the additional ignition events do not raise the engine speed above the maximum speed threshold if the throttle valve is not actuated. The threshold used to begin test period may be the ignition threshold speed and the test period may begin in response to a speed detected below the ignition threshold speed or after an ignition event has occurred (which happens below the ignition threshold speed). In some implementations, the test period may begin with or right after an ignition event and in other implementations, the test period may begin sometime after an ignition event, for example, one cycle after an engine ignition event. Hence, after an ignition event due to the engine speed being below the ignition threshold speed, the test period may provide additional ignition events in one or more subsequent cycles up to each cycle within the test period.

Figure 23:
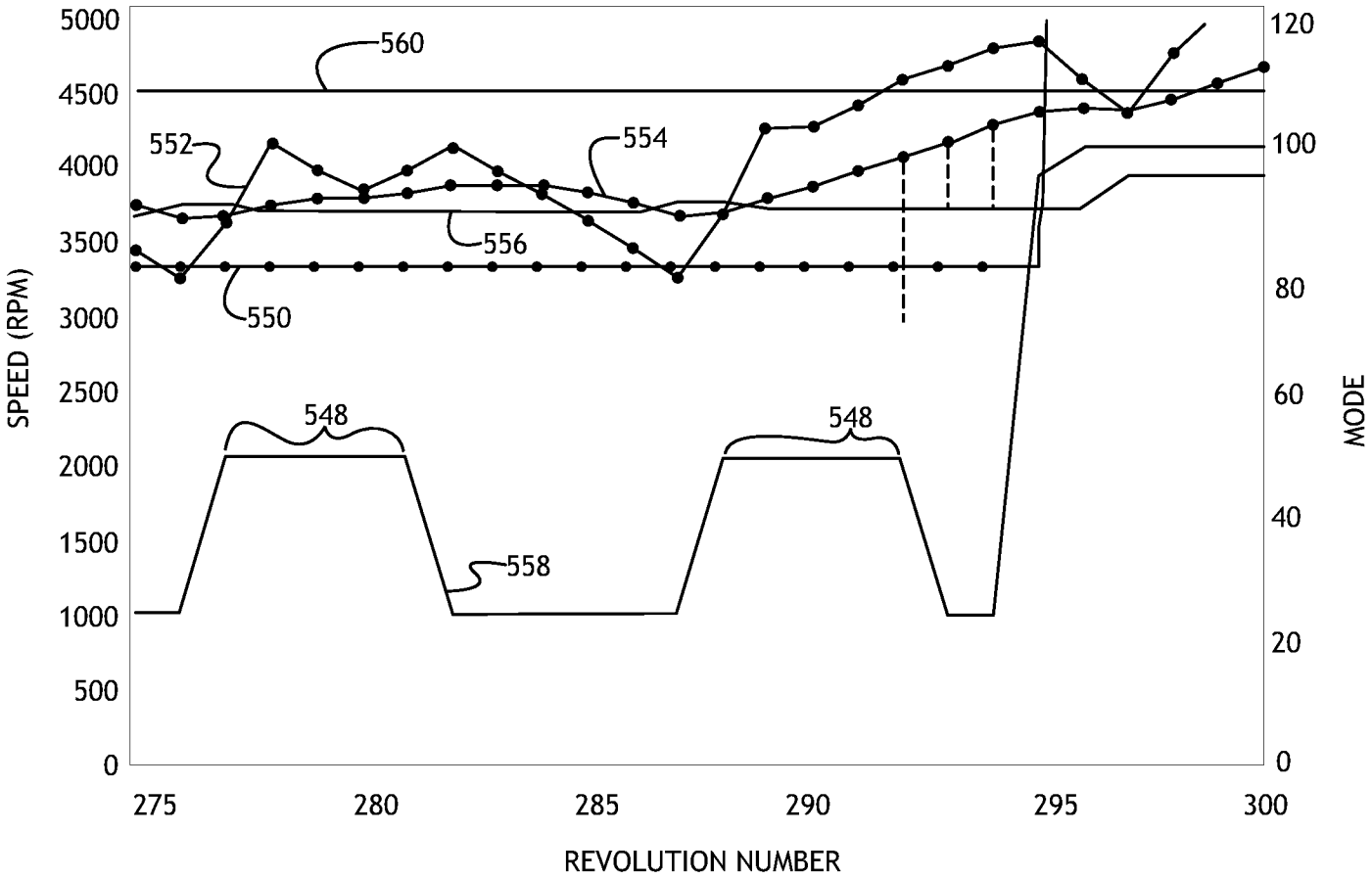
FIG. 23 is a graph showing engine speed data and engine control modes.

In the example shown in FIG. 23, a test period 548 follows each ignition event that is due to the engine speed being below the ignition threshold speed. In FIG. 23, engine speed in RPM's is along the left-hand vertical axis, engine revolutions are along the horizontal axis, and a value indicative of the engine operating scheme is along the righthand vertical axis. Further, the line 550 indicates the ignition threshold speed, line 552 indicates the engine speed as detected each revolution, line 554 indicates an averaged or filtered current engine speed (filtering or averaging may be used to reduce the variance in engine speed across two or more revolutions), line 556 indicates an average or filtered reference engine speed indicative of a prior engine speed or an expected engine speed, and line 558 indicates whether the engine speed control scheme is being implemented or the test period. The test periods 548 in this graph are denoted by the flat top peaks of the line 558 and the engine control scheme periods occurring between the test periods.

In this example, each test period 548 lasts for four engine revolutions, although as noted above, other values may be used and the value may change depending upon certain factors, such as but not-limited to one or more of ambient temperature, time since the engine was started, engine temperature, engine operating stability (which may, but need not, be determined as a function of cycle-to-cycle or revolution-to-revolution speed change) and the like. In the example shown, the engine is a two-cycle engine and an ignition event occurs each of the four engine revolutions during the test period. To determine if the throttle valve has been actuated, the filtered current engine speed shown by line 554 is compared to the filtered reference engine speed of line 556 and if the difference in those speeds is greater than a speed difference threshold, then the engine speed has increased to an extent greater than would occur if the throttle valve is not actuated. Thus, it may be determined that the throttle valve was actuated and the engine speed control scheme may be terminated in favor of normal engine operation or a modified engine warm-up scheme, or some other engine control scheme, as desired.

As a result of the first test period 548 shown in FIG. 23, which occurs from revolution number 277 to 280, the actual filtered current engine speed in line 554 did not exceed the filtered reference engine speed in line 556 by an amount greater than the speed difference threshold either during the test period or after the test period and before the beginning of the next test period. Therefore, the engine speed control scheme was not terminated and no ignition events were provided after that test period ended. As a result, the engine speed decreased each revolution after the test period, which is shown by line 552 from revolution number 282 to 287. The engine speed in revolution 287 was below the ignition threshold speed, so an ignition event occurred and the engine speed increased in revolution 288, as shown by line 552. It may also be noted that the engine speed between revolutions 275 and 288 remained below an engine maximum speed threshold, which in this example, is about 4,500 rpm and is shown by line 560.

In this example, the engine speed continued to increase in subsequent revolutions resulting in the filtered current engine speed shown in line 554 also increasing, and increasing relative to the reference engine speed shown in line 556. In this example, the filtered current engine speed (line 554) did not exceed the reference engine speed (line 556) by an amount greater than the speed difference threshold during the test period, but did during the period after the test period and before the next ignition event, in other words, the engine speed increased as a result of the earlier ignition events to a point where the speed different threshold was exceeded. In the example shown, this occurred in revolution 294 and the engine speed control scheme was terminated thereafter, as shown by mode line 558 (which increases to a value of 100 indicating that the engine speed control scheme has been terminated). If the speed difference threshold were exceeded during the test period 548, then the test period may have been terminated as well as the engine control scheme, although this is not necessary and a comparison of the current and reference speeds in lines 554 and 556 may be made, in at least some implementations, only after the test period has ended. In this phase, the engine speed may exceed the engine maximum speed threshold 560 because the throttle valve has been actuated by the user. This occurs at about revolution 291 or 292 in the example shown.

The speed difference threshold may be set at any desired value or values. The speed difference threshold may be variable or may change depending upon various factors such as, but not limited to, ignition timing, ambient temperature, engine temperature, time or number of revolutions since the engine was started, engine stability, etc. The speed difference value or values may be stored in any suitable way (e.g. lookup table(s), map(s), chart(s), etc) to be accessible by a controller or microprocessor used to implement the methods set forth herein. In the example shown, the engine temperature was about 40° C. and the speed difference threshold for that temperature was 485 rpm. In revolutions 275 to 293, the speed difference (between lines 554 and 556) was less than 485 rpm so the engine speed control scheme including the test periods was active. However, in revolution 294, the speed difference exceeded 485 rpm (as shown, it was about 540 rpm) so the engine speed control scheme was terminated.

The filtering or averaging of speeds may be done in any suitable way to reliably track engine speed characteristics over two or more revolutions and reduce the variability that occurs, such as due to engine ignition events. The revolutions may be consecutive revolutions or chosen at selected points of operation, as desired. The revolutions may be chosen only within the test period, only within the engine speed control scheme not including the test period, including one or more ignition events, or not including an ignition event, as desired. In at least some implementations, the filtered current engine speed averages the speed from two or more engine revolutions in which an ignition event did not occur. In other implementations, the median speed may be chosen, or the maximum speed may be chosen from two or more engine revolutions in which an ignition event did not occur. The revolutions may be consecutive or revolutions including an ignition event may occur between the revolutions used to determine the filtered current engine speed. In the example shown in FIG. 24, the highest engine speed during the last three revolutions without an ignition event is used as the filtered current engine speed. Also in the example shown, the filtered reference engine speed is an average of the engine speed during the last three revolutions without an ignition event. Hence, in the example shown, the maximum speed during the three revolutions is compared to the average of the engine speeds during those three revolutions, and the difference is compared to the speed difference threshold. Of course, other numbers of revolutions may be used, the same number of revolutions need not be used for the filtered current and filtered reference engine speeds, and other averaging or determination methods may be used.

In addition to or instead of the filtered values noted above, the rate of change of an engine speed (actual or the filtered current engine speed or some other determined speed) from two or more revolutions may be compared to a threshold rate of change. The revolutions may be consecutive, or chosen as desired, including, but not limited to, exclusion of the revolutions including an ignition event. The rate of change will generally be greater if the throttle valve has been actuated than if it has not been actuated so the rate of change may be used to determine if the throttle valve has been actuated. The rate of change may be reviewed for one time period or for more than one time period, if desired. In one example, the rate of engine speed change from a first revolution to a second revolution is compared to a first threshold, and the rate of engine speed change from the second revolution to the third revolution is compared to a threshold, which may be the first threshold or a second threshold. The first and second thresholds may be the same or different than each other (they may be the same or different in certain circumstances, or all the time). In addition to or instead, the total rate of change from the first revolution to the third revolution may be compared against another threshold. In at least one implementation, all three speed rates of change must be greater than the corresponding threshold(s) in order for the system to determine that the throttle valve has been actuated. Of course, other number of revolutions, ways to choose revolutions and thresholds may be used in the rate of engine speed change analysis, as desired. As set forth above, the engine speeds and other data may be stored in any suitable way on any suitable storage media or component, such as a memory device, buffer or combination of storage media.

Accordingly, in at least one implementations, the method 500 begins after the engine has been started. An engine speed control scheme is initiated to maintain the engine speed below a maximum speed threshold. At step 502, the engine speed is compared to an ignition threshold. If the engine speed is greater than the ignition threshold, then no ignition event is provided in that engine cycle or revolution and the method returns to the start. If the engine speed is less than the ignition threshold, then an ignition event is provided at 504 in that engine cycle or revolution and the method continues to step 506 in which the engine speed control is disabled, at least in part, during the test period. One or more additional ignition events occur in step 506.

In step 508, the engine speed change is compared to one or more thresholds to determine if the engine speed change during or after the test period indicates that the throttle valve has been actuated. If the engine speed change is less than the threshold(s), throttle valve actuation is not indicated and the method returns to the start. If the engine speed change is greater than the threshold(s), throttle valve actuation is determined and the method proceeds to step 510 in which the engine speed control scheme is terminated, and then the method ends. Of course, other methods may be used as set forth above.

It is to be understood that the foregoing description is not a definition of the invention, but is a description of one or more preferred embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. For example, a method having greater, fewer, or different steps than those shown could be used instead. All such embodiments, changes, and modifications are intended to come within the scope of the appended claims.

As used in this specification and claims, the terms "for example," "for instance," "e.g.," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

What is claimed is:

1. A method of maintaining an engine speed below a first threshold, comprising:

(a) determining an engine speed;

(b) comparing the engine speed to a second threshold that is less than the first threshold;

(c) allowing an engine ignition event to occur during a subsequent engine cycle if the engine speed is less than the second threshold; and (d) skipping at least one subsequent engine ignition event if the engine speed is greater than the second threshold, wherein the second threshold is less than the first threshold by a maximum acceleration of the engine after one ignition event so that an ignition event when the engine speed is less than the second threshold does not cause the engine speed to increase above the first threshold.

2. The method of claim 1 wherein the second threshold is at least 1,000 rpm lower than the first threshold.

3. The method of claim 1 wherein step (d) includes skipping consecutive ignition events to allow the engine speed to decrease during consecutive engine cycles.

4. A method of maintaining an engine speed below a first threshold, comprising:

(a) determining an engine speed;

(b) comparing the engine speed to a second threshold that is less than the first threshold;

(c) allowing an engine ignition event to occur during a subsequent engine cycle if the engine speed is less than the second threshold;

(d) skipping at least one subsequent engine ignition event if the engine speed is greater than the second threshold; and (e) determining when the user actuates a throttle valve associated with the engine and wherein the method terminates when throttle valve actuation is detected.

5. The method of claim 4 wherein a switch having at least two states is associated with the throttle valve and wherein the step of determining when the user actuates the throttle valve is accomplished by determining a change in the state of the switch.

6. The method of claim 4 wherein the step of determining when the user actuates the throttle valve is accomplished by providing additional ignition events during a test period and comparing at least one of the engine speed, engine speed change or rate of engine speed change in one or more subsequent revolutions to one or more thresholds to determine if the throttle valve has been actuated.

7. The method of claim 1 which includes:

(e) setting a counter to a first value;

(f) if the engine speed in step (b) of claim 1 is not less than the second threshold then setting the counter to a second value different than the first value;

(g) if the engine speed in step (b) of claim 1 is less than the second threshold then determining if the counter value is equal to the first value;

(h) if the counter value from (g) is equal to the first value, then proceeding to step (c) of claim 1 and then to step (f);

(i) if the counter value from (g) is not equal to the first value, then proceeding to step (d) of claim 1, then changing the counter value to a value closer to the first value and proceeding to step (j);

(j) after step (h) or step (i) determining if the current engine speed is less than a third threshold, and if so, returning to step (f) and if not, then setting the counter to a third value.

8. The method of claim 7 wherein the magnitude of the second value is a function of the magnitude by which the engine speed is greater than the second threshold.

9. The method of claim 7 wherein the second value is the same as the third value.

10. The method of claim 7 wherein the third threshold is less than the second threshold and the third value is less than the second value.

11. The method of claim 7 wherein the third value represents a normal engine idling speed or a range of engine idling engine speeds.

12. The method of claim 7 wherein the second threshold represents a fast idle engine speed or a range of engine speeds associated with a fast idling engine.

13. The method of claim 7 which also includes the step of advancing the engine ignition timing before step (b) to increase the engine speed compared to an ignition timing that is less advanced.

14. The method of claim 13 which also includes the step of changing the ignition timing to a less advanced timing if the engine speed is greater than the second threshold.

15. The method of claim 1 which also includes determining if the engine is being operated in a normal idle mode, a wide open throttle mode, or is decelerating from a fast idle mode to a normal idle mode, and if the engine is in a normal idle mode, a wide open throttle mode, or is decelerating from a fast idle mode to a normal idle mode, then terminating the method of maintaining an engine speed below a first threshold so that the engine can subsequently operate at a level that is greater than the first threshold.

16. The method of claim 15 wherein the step of determining if the engine is in normal idle mode is done by comparing the engine speed to at least one engine speed threshold that is lower than the first threshold for multiple engine revolutions.

17. The method of claim 15 wherein the step of determining if the engine is decelerating from a fast idle mode to a normal idle mode is done by detecting deceleration of the engine for a threshold number of consecutive engine revolutions.

18. The method of claim 15, which also comprises counting the number of consecutive engine revolutions without an ignition event and storing that number in a buffer, and wherein the step of determining if the engine is in wide open throttle mode is done by analyzing the values stored in the buffer.

19. The method of claim 4 wherein the engine is operable in a fast-idle mode in which the engine speed is greater than a normal idle mode, and wherein the method includes determining if the engine is operating in the fast-idle mode, and wherein the method continues when the engine is operating in the fast-idle mode and the method terminates when the fast-idle mode is terminated.

* * * * *